US007876302B2

(12) United States Patent
Aoki

(10) Patent No.: US 7,876,302 B2
(45) **Date of Patent: *Jan. 25, 2011**

(54) DRIVING CIRCUIT FOR ELECTRO-OPTICAL PANEL AND DRIVING METHOD THEREOF, ELECTRO-OPTICAL DEVICE, AND ELECTRONIC APPARATUS HAVING ELECTRO-OPTICAL DEVICE

(75) Inventor: Koji Aoki, Fujimi-cho (JP)

(73) Assignee: Seiko Epson Corporation, Tokyo (JP)

( * ) Notice: Subject to any disclaimer, the term of this patent is extended or adjusted under 35 U.S.C. 154(b) by 1351 days.

This patent is subject to a terminal disclaimer.

(21) Appl. No.: 11/135,537

(22) Filed: May 24, 2005

(65) Prior Publication Data

US 2006/0017716 A1 Jan. 26, 2006

(30) Foreign Application Priority Data

Jul. 26, 2004 (JP) ..... 2004-216891

(51) Int. Cl.
*G09G 3/36* (2006.01)

(52) U.S. Cl. ..... 345/100; 345/211

(58) Field of Classification Search ..... 345/87–102, 345/204

See application file for complete search history.

(56) References Cited

U.S. PATENT DOCUMENTS 4,855,863 A 8/1989 Yoshitake
5,619,222 A 4/1997 So
5,793,588 A 8/1998 Jeong
6,166,713 A * 12/2000 Asai et al. ..... 345/92
6,333,661 B1 12/2001 Ando et al.
6,671,146 B1 12/2003 Hashimoto et al.
6,717,151 B2 * 4/2004 Tashiro et al. ..... 250/370.11
6,788,281 B2 * 9/2004 Ando et al. ..... 345/100
6,879,312 B2 * 4/2005 Ota ..... 345/98
6,897,839 B2 * 5/2005 Noguchi et al. ..... 345/82
6,909,413 B2 * 6/2005 Nanno et al. ..... 345/87
7,021,748 B2 * 4/2006 Fujii et al. ..... 347/59
7,023,415 B2 4/2006 Fujita et al.
7,256,778 B1 * 8/2007 Choi ..... 345/213

(Continued)

FOREIGN PATENT DOCUMENTS

CN 1297580 A 5/2001

(Continued)

*Primary Examiner*—Nitin Patel
(74) *Attorney, Agent, or Firm*—Oliff & Berridge, PLC

(57) ABSTRACT

A driving circuit for an electro-optical panel, in which a plurality of pixel portions are provided in an image display region, has a plurality of power supply lines that are respectively supplied with a plurality of power supplies having different potentials from a power supply circuit, a shift register that outputs transfer signals defining timings at which image signals are supplied to the plurality of pixel portions, a level shifter that is connected to at least one power supply line and another power supply line supplied with different potentials among the plurality of power supply lines and that increases the voltage levels of the output transfer signals by using the power supplies having the different potentials supplied through the one power supply line and another power supply line, and an electrostatic protecting circuit having a diode that is provided between the one power supply line and another power supply line and that forms an electrical path to release static electricity applied to one of the one power supply line and another power supply line to the other.

26 Claims, 11 Drawing Sheets

U.S. PATENT DOCUMENTS

| | | | | |
|---|---|---|---|---|
| 7,336,247 | B2 * | 2/2008 | Akimoto et al. | 345/82 |
| 7,408,535 | B2 * | 8/2008 | Fujita | 345/100 |
| 7,453,420 | B2 * | 11/2008 | Watanabe et al. | 345/55 |
| 7,499,041 | B2 * | 3/2009 | Komatsu et al. | 345/204 |
| 7,589,479 | B2 * | 9/2009 | Kim | 315/291 |
| 2001/0015712 | A1 | 8/2001 | Hashimoto | |
| 2002/0000965 | A1 * | 1/2002 | Ando et al. | 345/87 |
| 2002/0017611 | A1 * | 2/2002 | Tashiro et al. | 250/370.11 |
| 2002/0196208 | A1 * | 12/2002 | Nanno et al. | 345/55 |
| 2003/0011586 | A1 * | 1/2003 | Nakajima | 345/211 |
| 2004/0004595 | A1 * | 1/2004 | Isami et al. | 345/89 |
| 2004/0021739 | A1 * | 2/2004 | Fujii et al. | 347/57 |
| 2004/0041771 | A1 * | 3/2004 | Murase et al. | 345/98 |
| 2004/0046718 | A1 * | 3/2004 | Osame et al. | 345/80 |
| 2004/0100435 | A1 * | 5/2004 | Baek et al. | 345/98 |
| 2006/0022988 | A1 * | 2/2006 | Soroushi et al. | 345/564 |
| 2006/0077162 | A1 * | 4/2006 | Chou et al. | 345/92 |

FOREIGN PATENT DOCUMENTS

| | | | |
|---|---|---|---|
| CN | 1452182 | A | 10/2003 |
| EP | 0 464 751 | A2 | 1/1992 |
| JP | A-63-036557 | | 2/1988 |
| JP | A-04-111350 | | 4/1992 |
| JP | A-04-195123 | | 7/1992 |
| JP | A-04-318396 | | 11/1992 |
| JP | A-6-335162 | | 12/1994 |
| JP | A-7-22617 | | 1/1995 |
| JP | A-07-028094 | | 1/1995 |
| JP | A-08-211854 | | 8/1996 |
| JP | A-09-191081 | | 7/1997 |
| JP | A 10-294383 | | 11/1998 |
| JP | A 2000-098338 | | 4/2000 |
| JP | B2-3107312 | | 9/2000 |
| JP | B2-3154508 | | 2/2001 |
| JP | A-2001-298157 | | 10/2001 |
| JP | A-2003-149668 | | 5/2003 |
| JP | A 2003-308050 | | 10/2003 |

* cited by examiner

DRIVING CIRCUIT FOR ELECTRO-OPTICAL PANEL AND DRIVING METHOD THEREOF, ELECTRO-OPTICAL DEVICE, AND ELECTRONIC APPARATUS HAVING ELECTRO-OPTICAL DEVICE

BACKGROUND OF THE INVENTION

1. Technical Field

The present invention relates to a driving circuit for an electro-optical panel such as an organic EL panel and a driving method thereof, an electro-optical device having the driving circuit of the electro-optical panel, and an electronic apparatus having the electro-optical device.

2. Related Art

A driving circuit for an electro-optical panel such as an organic electroluminescent (EL) panel is incorporated into a substrate of the electro-optical panel so as to serve as an internal circuit for driving scanning lines or data lines by using externally supplied power, or is attached later to the substrate so as to function as an external IC circuit. Such a driving circuit may be deteriorated or broken for various reasons. In particular, a problem is breakdown caused by the stress of electrostatic discharge, that is, electrostatic breakdown, which occurs while the electro-optical device is assembled or transported. At the time of the assembling process, static electricity is generated around the driving circuit or the electro-optical device. When the static electricity is applied to wiring lines-connected to the driving circuit, the driving circuit is deteriorated or broken.

Accordingly, in order to prevent the deterioration and breakdown of the driving circuit due to the static electricity, a protecting circuit is provided in a signal path through which a signal is input/output in the driving circuit (for example, see Japanese Unexamined Patent Application Publication Nos. 10-294383 and 2003-308050). Specifically, the protecting circuit is provided as an input protecting circuit for an input terminal, to which various signals including clock signals, inversion clock signals, and start pulses are input from the outside of the driving circuit. Alternatively, the protecting circuit is provided as an output protecting circuit for an output terminal, through which various signals including scanning signals and end pulses are output to the outside of the driving circuit.

In addition, a technique in which, in an insulating gate-type transistor circuit device, static electricity accumulated in a circuit portion, which is in a floating state, is effectively discharged so as to prevent the breakdown of an element due to the static electricity is proposed (for example, see Japanese Unexamined Patent Application Publication No. 2000-98338).

In the driving circuit for the organic EL panel, a protecting diode is provided at the outside of the driving circuit as a countermeasure against static electricity which penetrates into the driving circuit from the outside. In this case, however, it is difficult to release the static electricity generated at the inside of the driving circuit to the outside of the driving circuit. For example, in a process of forming power supply lines to supply power in order to drive a level shifter, a shift register, or a buffer included in the driving circuit, when resist is removed after the power supply lines are patterned, static electricity may be generated at the power supply lines. The static electricity may cause electrostatic breakdown of the level shifter included and the buffer connected to the level shifter in the driving circuit. This may result in a lowering of the yield in a process of manufacturing the organic EL panel.

SUMMARY

An advantage of the invention is that it provides a driving circuit and a driving method for an electro-optical panel which are capable of preventing electrostatic breakdown of a driving circuit for an electro-optical panel, an electro-optical device having the driving circuit, and an electronic apparatus having the electro-optical device.

According to a first aspect of the invention, there is provided a driving circuit for an electro-optical panel in which a plurality of pixel portions are provided in an image display region. The driving circuit for an electro-optical panel includes a plurality of power supply lines that are respectively supplied with a plurality of power supplies having different potentials from a power supply circuit, a shift register that outputs transfer signals defining timings when image signals are supplied to the plurality of pixel portions, a level shifter that is connected to at least one power supply line and another power supply line supplied with different potentials among the plurality of power supply lines and that increases the voltage levels of the output transfer signals by using the power supplies having the different potentials supplied through the one power supply line and the other power supply line, and an electrostatic protecting circuit having a diode that is provided between the one power supply line and the other power supply line and that forms an electrical path to release static electricity applied to one of the one power supply line and the other power supply line to the other.

According to the first aspect of the invention, when the driving circuit of the electro-optical panel is operated, various signals to drive the electro-optical panel are transferred from the shift register at predetermined timings. The level shifter shifts the voltage levels of various signals transferred from the shift register and outputs them as the transfer signals. The driving circuit supplies the image signals to the electro-optical panel through the data lines according to the transfer signals and drives the electro-optical panel. At this time, the driving circuit has the one power supply line and the other power supply line to supply the different potentials to the level shifter, and the level shifter is driven by using the power supplies supplied through the two power supply line.

In this case, the electrostatic protecting circuit has the diode that is provided between the one power supply line and the other power supply line. The electrostatic protecting circuit forms an electrical path that releases the static electricity applied to one of the one power supply line and the other power supply line to the other. Therefore, at the time of manufacturing an electro-optical device in which the driving circuit is built in the electro-optical panel or the driving circuit is attached to the outside of the electro-optical panel, even though a relatively high voltage is generated due to static electricity between the one power supply line and the other power supply line, it is possible to suppress electrostatic breakdown of the level shifter due to the static electricity by releasing the static electricity through the current path. For example, when assembling or transporting the electro-optical panel, or when the electro-optical panel is operated, it is possible to prevent the electrostatic breakdown of the level shifter due to the static electricity generated in the driving circuit.

In addition, since the electrostatic breakdown of the level shifter can be suppressed, the electrostatic breakdown of the shift register or the like electrically connected to the level shifter can be suppressed. Therefore, it is possible to protect the overall driving circuit from the static electricity.

According to the first aspect of the invention, it is preferable that the driving circuit include a data line driving circuit that supplies the image signals to the pixel portions through signal lines provided in the electro-optical panel according to the transfer signals having increased voltages and that drives the electro-optical panel.

In this case, since a driving frequency is higher than that of a scanning line driving circuit, it is possible to protect the level shifter or shift register with respect to the data line driving circuit, in which the level shifter is suitably used, from the static electricity.

According to the first aspect of the invention, it is preferable that the electro-optical panel is a current-driven electro-optical panel, and the data line driving circuit samples or latches the image signals according to the transfer signals having increased voltages and supplies the sampled or latched image signals to the signal lines.

In this case, it is important that an image signal having a relatively large current is supplied in order to drive the current-driven electro-optical panel. In order to sample or latch the image signal, a large-scaled switch such as a TFT having a relatively large size is used. In addition, in order to control the large-scaled switch, the level shifter amplifies the voltage of the transfer signal. As such, according to the transfer signal having the increased voltage, the image signal is sampled or latched by the large-scaled switch and is supplied to the signal line. Therefore, by amplifying the voltage of the transfer signal to sample or latch the image signal, the image signal having sufficient current is supplied. As a result, it is possible to favorably drive the current-driven electro-optical panel.

In addition, according to the first aspect of the invention, it is preferable that the driving circuit include a scanning line driving circuit that uses the transfer signals having increased voltages as scanning signals, supplies the scanning signals to the pixel portions through a plurality of scanning lines provided in the electro-optical panel, and drives the electro-optical panel.

In this case, it is possible to protect the level shifter and the shift register with respect to the scanning line driving circuit, that outputs the transfer signals to the scanning signals, from the static electricity.

According to the first aspect of the invention, it is preferable that the electro-optical panel is an organic EL panel.

In this case, a driving current that causes the organic EL panel to emit light can be sufficiently supplied. Specifically, since the voltage level of the transfer signal is shifted by the shift register, it is possible to shift the voltage level of the image signal supplied to the organic EL panel according to the transfer signal and to allow a large current according to the image signal to flow in the organic EL element included in the pixel which the organic EL panel has. Therefore, it is possible to sufficiently ensure the light-emitting amount of the organic EL element and to improve image quality of the organic EL panel.

According to the first aspect of the invention, it is preferable that a plurality of diodes are connected in parallel between the one power supply line and the other power supply line.

In this case, when there is some inconsistency at any of the plurality of diodes connected in parallel between the one power supply line and the other power supply line, it is possible to form the current path through other diodes, except for the diode in which the inconsistency occurs. Therefore, it is possible to reliably discharge the static electricity generated at the power supply lines through the current path and to prevent the driving circuit from being broken due to the static electricity.

According to the first aspect of the invention, it is preferable that the electrostatic protecting circuit is provided for each stage of the level shifter.

In this case, it is possible to discharge the static electricity generated at the power supply line near the level shifter and to reliably protect the respective stages of the level shifter from the static electricity.

According to the first aspect of the invention, it is preferable that the electrostatic protecting circuit is provided for every plural stages of the level shifter.

In this case, the diode is provided for every plural stages of the level shifter, and thus the number of the diodes can be reduced as compared to the case in which the diode is provided for each stage of the level shifter. When the number of the diodes is reduced, in the one power supply line and another supply line, the current path is formed by the diode provided for every plural stages of the level shifter, and thus it is possible to discharge the static electricity generated at the power supply lines through the current path. In addition, by reducing the number of the diodes, it is possible to improve the durability of the electro-optical panel and to reduce a manufacturing cost of the electro-optical panel.

According to the first aspect of the invention, it is preferable that the driving circuit of the electro-optical panel further includes a buffer that is connected to an output side of the level shifter and that is connected to the one power supply line and another power supply line to buffer the transfer signals having the increased voltages by using the power supplies having the different potentials.

In this case, it is possible to arrange a waveform or output timing of the transfer signal by the buffer and to supply the transfer signal more reliably.

According to the first aspect of the invention, it is preferable that the one power supply line and the other power supply line include at least one of a highest power supply line to supply a power supply having a highest potential and a lowest power supply line to supply a power supply having a lowest potential among the plurality of power supply lines. The electrical path includes at least one of a path passing through the highest power supply line and a path passing through the lowest power supply line.

In this case, the electrostatic protecting circuit maintains the potential on the corresponding power supply line at a potential equal to or less than that of the power supply having the highest potential or a potential equal to or more than that of the power supply having the lowest potential among the power supplies supplied from the power supply circuit. Therefore, when the corresponding driving circuit is operated, it is possible to maintain the potentials on the plurality of power supply lines with the potential equal to of less than that of the power supply having the highest potential and the potential equal to or more than that of the power supply having the lowest potential.

According to a second aspect of the invention, there is provided a driving circuit having an electronic circuit that has a plurality of unit circuits, a power supply line that commonly supplies power to the plurality of unit circuits, a power input line that connects from the power supply line to each of the plurality of unit circuits, and a protecting circuit that is provided on the power input line.

In this case, when assembling or transporting the electro-optical panel or when the electro-optical panel is operated, it is possible to prevent electrostatic breakdown of the plurality of unit circuits due to the static electricity generated in the driving circuit.

According to the second aspect of the invention, it is preferable that the driving circuit is a driving circuit for an electrooptical panel in which a plurality of pixel portions are provided in an image display region, the power supply lines have at least one power supply line and another power supply line which supply different potentials, respectively, and the unit circuit include a shift register that outputs transfer signals defining timings at which image signals are supplied to the plurality of pixel portions and a level shifter that increases the voltage levels of the output transfer signals by using the power supplies having the different potentials.

In this case, since the electrostatic breakdown of the level shifter can be suppressed, the electrostatic breakdown of the shift register electrically connected to the level shifter can be suppressed. As a result, it is possible to protect the overall driving circuit from the static electricity.

According to the second aspect of the invention, it is preferable that the driving circuit includes a data line driving circuit that supplies the image signals to the pixel portions through signal lines provided in the electro-optical panel according to the transfer signals having increased voltages and that drives the electro-optical panel.

In this case, since a driving frequency is higher than that of a scanning line driving circuit, it is possible to protect the level shifter or shift register with respect to the data line driving circuit, in which the level shifter is suitably used, from the static electricity.

According to the second aspect of the invention, it is preferable that the electro-optical panel is a current-driven electro-optical panel, and the data line driving circuit samples or latches the image signals according to the transfer signals having the increases voltages and supplies the sampled or latched image signals to the signal lines.

In this case, by amplifying the voltage of the transfer signal to sample or latch the image signal, the image signal having the sufficient current is supplied, so that it is possible to favorably drive the current-driven electro-optical panel.

According to the second aspect of the invention, it is preferable that the driving circuit includes a scanning line driving circuit that uses the transfer signals having increased voltages as scanning signals, supplies the scanning signals to the pixel portions through a plurality of scanning lines provided in the electro-optical panel, and drive the electro-optical panel.

In this case, it is possible to protect the level shifter and the shift register with respect to the scanning line driving circuit, that outputs the transfer signal as the scanning signal, from the static electricity.

According to the second aspect of the invention, it is preferable that the electro-optical panel is an organic EL panel.

In this case, it is possible to sufficiently ensure the light-emitting amount of the organic EL element and to improve image quality of the organic EL panel.

According to the second aspect of the invention, it is preferable that the protecting circuit is a diode.

In this case, since the static electricity generated at the power supply line is reliably discharged through the current path, the electrostatic breakdown of the driving circuit by the static electricity can be suppressed.

According to the second aspect of the invention, the protecting circuit is provided for each stage of the level shifter.

In this case, since the static electricity generated at the power supply line near the level shifter can be discharged through the diode arranged near the level shifter, the respective stages of the level shifter can be reliably protected from the static electricity.

According to the second aspect of the invention, it is preferable that the protecting circuit is provided for every plural stages of the level shifter.

In this case, even though the number of the diodes is reduced, in the one power supply line and another power supply line, the current path is formed by the diode provided for every plural stages of the shift register. As a result, it is possible to discharge the static electricity generated at the power supply lines through the current path.

According to the second aspect of the invention, it is preferable that the driving circuit further includes a buffer that is connected to an output side of the level shifter and that is connected to the one power supply line and another power supply line to buffer the transfer signals having increased voltages by using the power supplies having the different potentials.

In this case, it is possible to arrange a waveform or output timing of the transfer signal by the buffer and to supply the transfer signal more reliably.

According to the second aspect of the invention, it is preferable that the one power supply line and another power supply line include at least one of a highest power supply line to supply a power supply having a highest potential and a lowest power supply line to supply a power supply having a lowest potential among the plurality of power supply lines, and the electrical path formed by the protecting circuit include at least one of a path passing through the highest power supply line and a path passing through the lowest power supply line.

In this case, when the driving circuit is operated, it is possible to maintain the potentials on the plurality of power supply lines at a potential equal to or less than that of the power supply having the highest potential and at a potential equal to or more than that of the power supply having the lowest potential.

According to a third aspect of the invention, there is provided a method of driving an electro-optical panel in which a plurality of pixel portions are provided in an image display region. The method includes supplying a plurality of power supplies having different potentials from a power supply circuit to a plurality of power supply lines, respectively, outputting transfer signals defining timings when image signals are supplied to the plurality of pixel portions by a shift register, increasing the voltage levels of the output transfer signals by using a power supply having the different potentials supplied through the one power supply line and another power supply line by a level shifter connected to at least the one power supply line and the other power supply line supplied with different potentials among the plurality of power supply lines, and forming an electrical path to release static electricity applied to one of the one power supply line and the other power supply line to the other by a diode which is provided between the one power supply line and another power supply line.

According to the third aspect of the invention, similar to the driving circuit of the above-described electro-optical panel, by releasing the static electricity through the electrical path, the electrostatic breakdown of the level shifter can be effectively suppressed.

According to a fourth aspect of the invention, there is provided an electro-optical device having the above-described driving circuit for an electro-optical panel and the electro-optical panel.

According to the fourth aspect of the invention, since the electrostatic breakdown of the driving circuit due to the static electricity generated at the power supply line can be suppressed, it is possible to improve the durability of the electro-optical device. In addition, it is possible to improve the yield of the electro-optical device in a manufacturing process and to reduce the cost of the electro-optical device.

According to a fifth aspect of the invention, there is provided an electronic apparatus having the above-described electro-optical device.

Since the electronic apparatus has the above-described electro-optical device, the electronic apparatus has a high yield, operates without troubles, and realizes high quality display. As the electronic apparatus, various electronic apparatuses such as a projection-type display device, a liquid crystal television, a cellular phone, an electronic organizer, a word processor, a viewfinder-type or monitor-direct-view-type video tape recorder, a workstation, a video phone, a POS terminal, a touch panel or the like may be exemplified. Further, the electronic apparatuses may include a liquid crystal device, an organic EL display device, and a display device using an electron emission element (Field Emission Display and Surface-Conduction Electron-Emitter Display), as well as an electrophoretic device such as an electronic paper.

The operations and other advantages of the invention will be apparent from the following embodiments.

BRIEF DESCRIPTION OF THE DRAWINGS

The invention will be described with reference to the accompanying drawings, wherein like numbers reference like elements, and wherein.

DESCRIPTION OF THE EMBODIMENTS

Embodiments of the invention will now be described in detail with reference to the accompanying drawings. In the following embodiments, a driving circuit of an electro-optical panel according to the invention is applied to a TFT active matrix driving-type organic EL display device.

First Embodiment

Configuration of Organic EL Display Device

Figure 1:
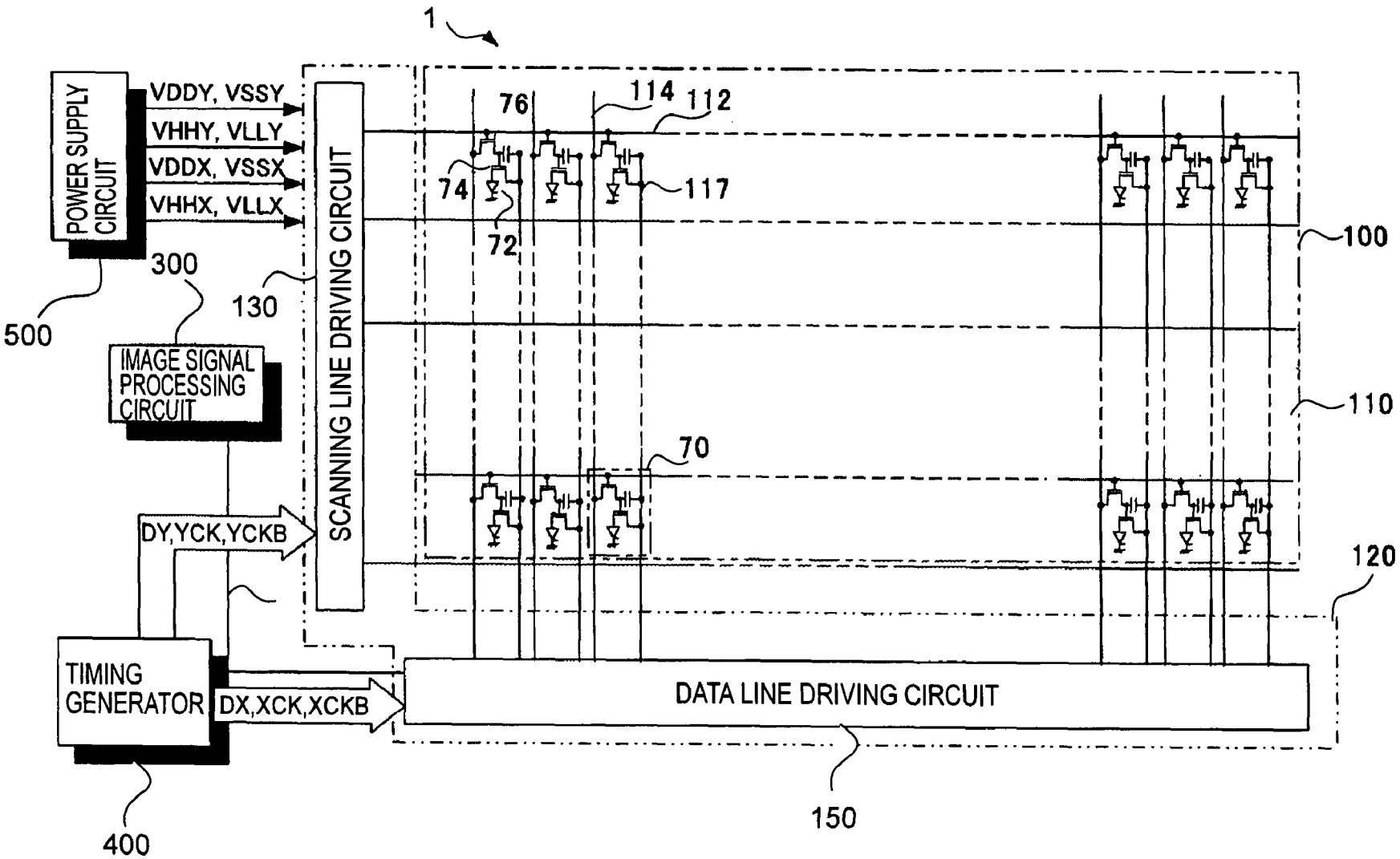
FIG. 1 is a block diagram showing the overall configuration of an organic EL display device according to a first embodiment of the invention.
Figure 2:
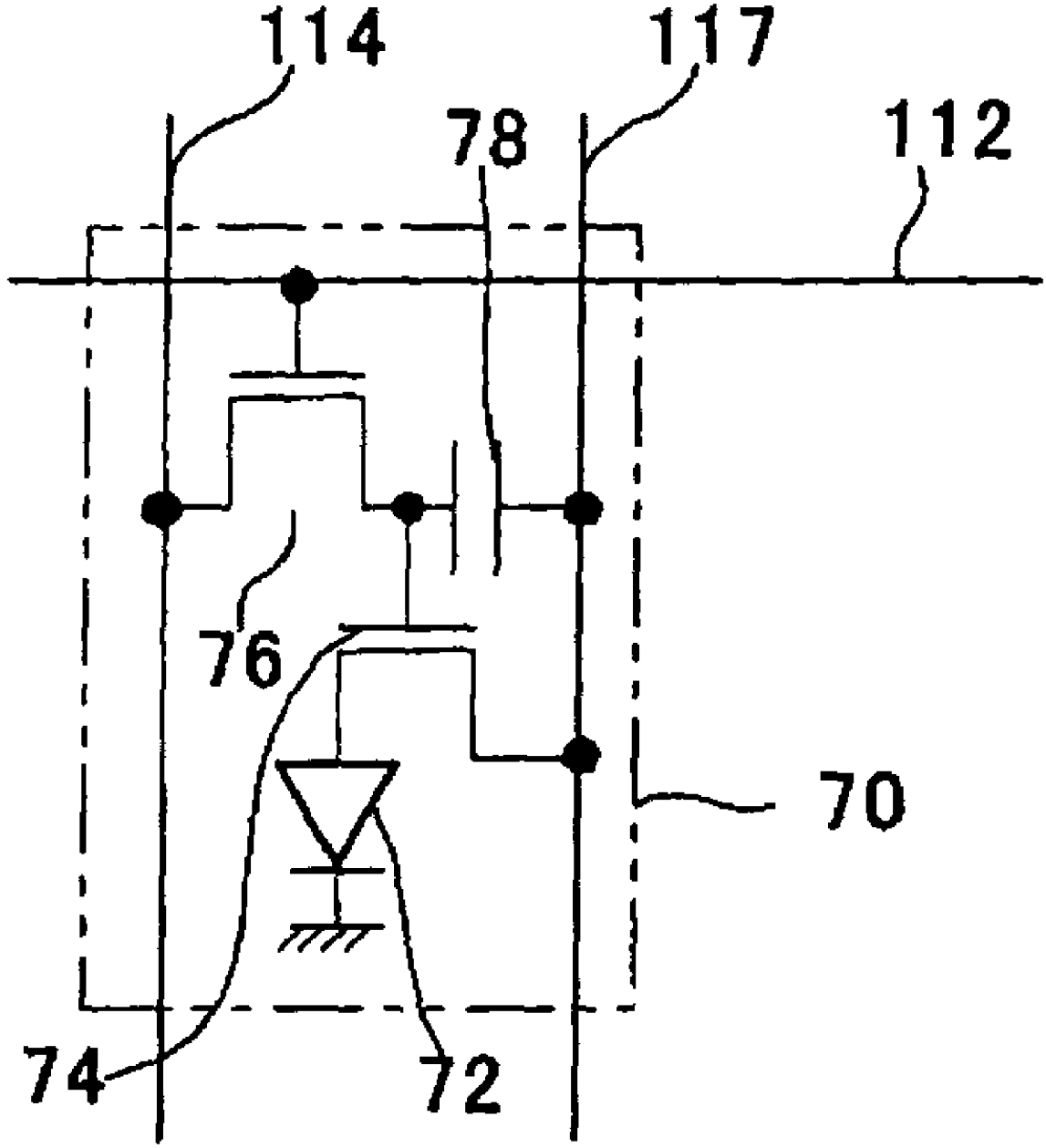
FIG. 2 is a block diagram showing the configuration of a pixel included in the organic EL display device according to the first embodiment of the invention.

First, the overall configuration of an organic EL display device according to a first embodiment and the configuration of each pixel will be described with reference to FIGS. 1 and 2. FIG. 1 is a block diagram showing the overall configuration of the organic EL display device according the first embodiment of the invention and FIG. 2 is a block diagram showing the configuration of each pixel.

In FIG. 1, an organic EL display device 1 which is an example of 'an electro-optical device' according to the invention mainly includes an organic EL panel 100 which is an example of 'an electro-optical panel' according to the invention, a driving circuit 120 which is an example of a driving circuit for 'an electro-optical panel' according to the invention, an image signal processing circuit 300, a timing generator 400, and a power supply circuit 500.

The organic EL panel 100 includes switching transistors 76 which function as switching elements for switching pixels and which are formed on an image display region 110 of an element substrate, driving transistors 74, and organic EL elements 72 formed on the element substrate. The organic EL elements 72 are arranged such that a cathode, an electron transporting layer, a light-emitting layer, a hole transporting layer, a transparent electrode, and a glass plate overlap one another. A counter substrate located at a side where light generated at the organic EL element is emitted may be made of a glass plate. Each of pixel portions 70 included in the organic EL panel 100 is connected to a current supply line 117. In addition, when the driving transistor 74 is turned on, the pixel portion is supplied with a driving current for driving the organic EL element 72 through the corresponding current supply line 117.

The timing generator 400 outputs various timing signals used for the respective elements of the organic EL panel 100. With a timing signal output unit which is a portion of the timing generator 400, a dot clock which is a clock of a minimum unit and which scans each pixel is created. In addition, a Y clock signal YCK, an inversion Y clock signal YCKB, an X clock signal XCK, an inversion X clock signal XCKB, a Y transfer start pulse DY, and an X transfer start pulse DX are generated on the basis of the dot clock.

When input image data is input from the outside, the image signal processing circuit 300 generates an image signal based on input image data. The image signal is latched or sampled by a latch circuit included in the data line driving circuit 150 and is supplied to the organic EL panel 100 through an image signal supply line L1. In the present embodiment, for convenience of explanation, one image signal supply line is provided. However, the invention is not limited thereto. For example, the organic EL elements for emitting light components corresponding to the respective colors of R, G, and B may be formed in the pixels, respectively, and a plurality of signal supply lines for supplying, as image signals, an R signal, a G signal, and a B signal corresponding to the respective colors of R, G, and B may be provided. In this case, three image signal supply lines may be provided and the pixels corresponding to the respective colors may be supplied with the image signals from the three image signal supply lines. Further, current supply lines which supply the driving current to the organic EL elements that emit the light component corresponding to the respective colors of R, G, and B may be provided for the organic EL elements that emit light components corresponding to the respective colors of R, G, and B, respectively.

The power supply circuit 500 generates a plurality of power supplies having different potentials to supply them to the organic EL panel 100.

In the present embodiment, the organic EL panel 100 is an organic EL panel having an internal driving circuit. The driving circuit 120 is constructed on the element substrate. Here, the driving circuit 120 is an example of 'a driving circuit' according to the invention and includes a scanning line driving circuit 130 and a data line driving circuit 150. Preferably, the driving circuit 120 is provided on a peripheral region of the element substrate together with various elements such as the switching transistors 76 and the driving transistors 74 with respect to the pixels provided in the image display region 110. However, such a driving circuit may be at least partially constructed as an external IC and may be provided later on the peripheral region.

In addition, the organic EL panel 100 has data lines 114 and scanning lines 112 which are arranged on the image display region 110 occupying a central portion of the element substrate in the vertical and horizontal directions, respectively. The data line 114 and the scanning line 112 are electrically connected to the driving transistor 74 to allow the driving current to flow in the organic EL element 72 included in each pixel portion 70, which is provided to correspond to an intersection of the data line 114 and the scanning line 112, and the switching transistor 76 that turns on/off the corresponding driving transistor 74. In addition, in the present embodiment, the total number of scanning lines 112 is m (where m is a natural number equal to or more than two) and the total number of data lines 114 is n (where n is a natural number equal to or more than two).

The data line driving circuit 150 sequentially supplies the image signal supplied from the image signal supply line L1 to the respective data lines 114.

The scanning line driving circuit 130 supplies the scanning signal to each row of the pixel portions 70 arranged in a matrix shape.

In FIG. 2, the pixel portion 70 includes the organic EL element 72 serving as the display element, the driving transistor 74 for supplying the driving current to the corresponding organic EL element 72, and the switching transistor 76 for turning on/off the driving transistor 74.

A source electrode of the switching transistor 76 is electrically connected to the data line 114 that is supplied with the image signal from the data line driving circuit 150. On the other hand, a gate electrode of the switching transistor 76 is electrically connected to the scanning line 112 that is supplied with a scanning signal described later. A drain electrode of the switching transistor 76 is connected to a storage capacitor 78. The respective pixel portions 70 are arranged in a matrix shape to correspond to the intersections of the scanning lines 112 and the data lines 114.

The scanning line 112 is electrically connected to the gate electrode of the switching transistor 76 and the data line 114 is electrically connected to the source electrode of the switching transistor. The current supply line 117 is connected to the source electrode of the driving transistor 74 and the storage capacitor 78.

The storage capacitor 78 is electrically connected to the gate electrode of the driving transistor 76 and applies a voltage according to the data signal, which is supplied to the pixel portion 70 through the data line 114, to the gate electrode of the driving transistor 74.

A source electrode of the driving transistor 74 is electrically connected to the current supply line 117. The driving transistor 74 is turned on/off according to the voltage applied to the gate electrode of the driving transistor 74. As a result, the driving transistor 74 allows the driving current to flow in the organic EL element 72 from the current supply line 117.

In addition to the configuration of the pixel circuit exemplified in FIGS. 1 and 2, various types of pixel circuits, such as a current-programmed pixel circuit, a voltage-programmed pixel circuit, a voltage comparison-type pixel circuit, and a subframe-type pixel circuit, each having a plurality of TFTs (for example, four) and a plurality of capacitors, may be employed.

Configuration of Data Line Driving Circuit

Figure 3:
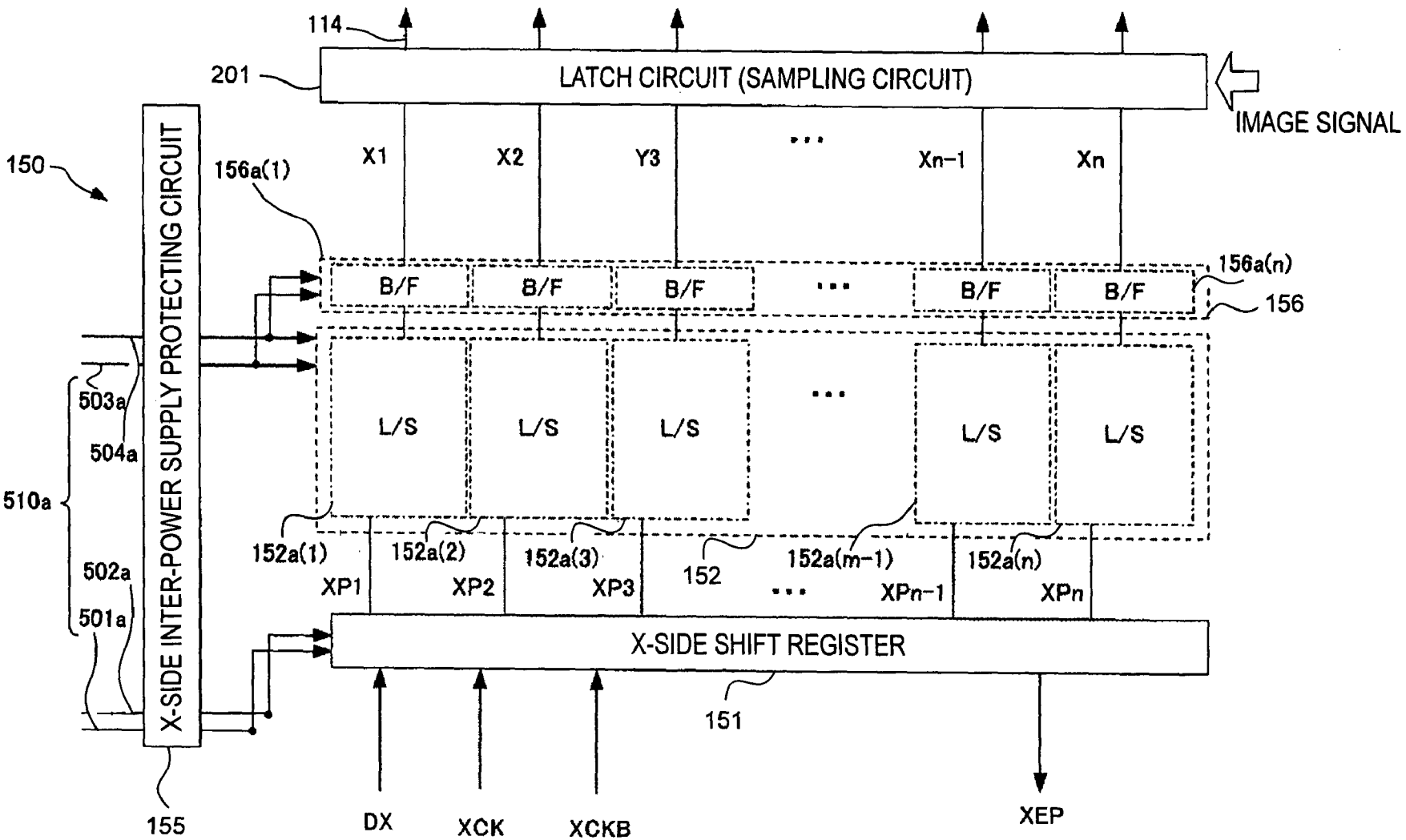
FIG. 3 is a block diagram showing a data line driving circuit included in the organic EL display device according to the first embodiment of the invention.

Next, the detailed configuration of the data line driving circuit 150 in the pixel circuit 120 will be described with reference to FIGS. 3 and 4. FIG. 3 is a block diagram showing the configuration of the data line driving circuit 150 and FIG. 4 is a block diagram showing an example of the configuration of an X-side level shifter 152.

Figure 4:
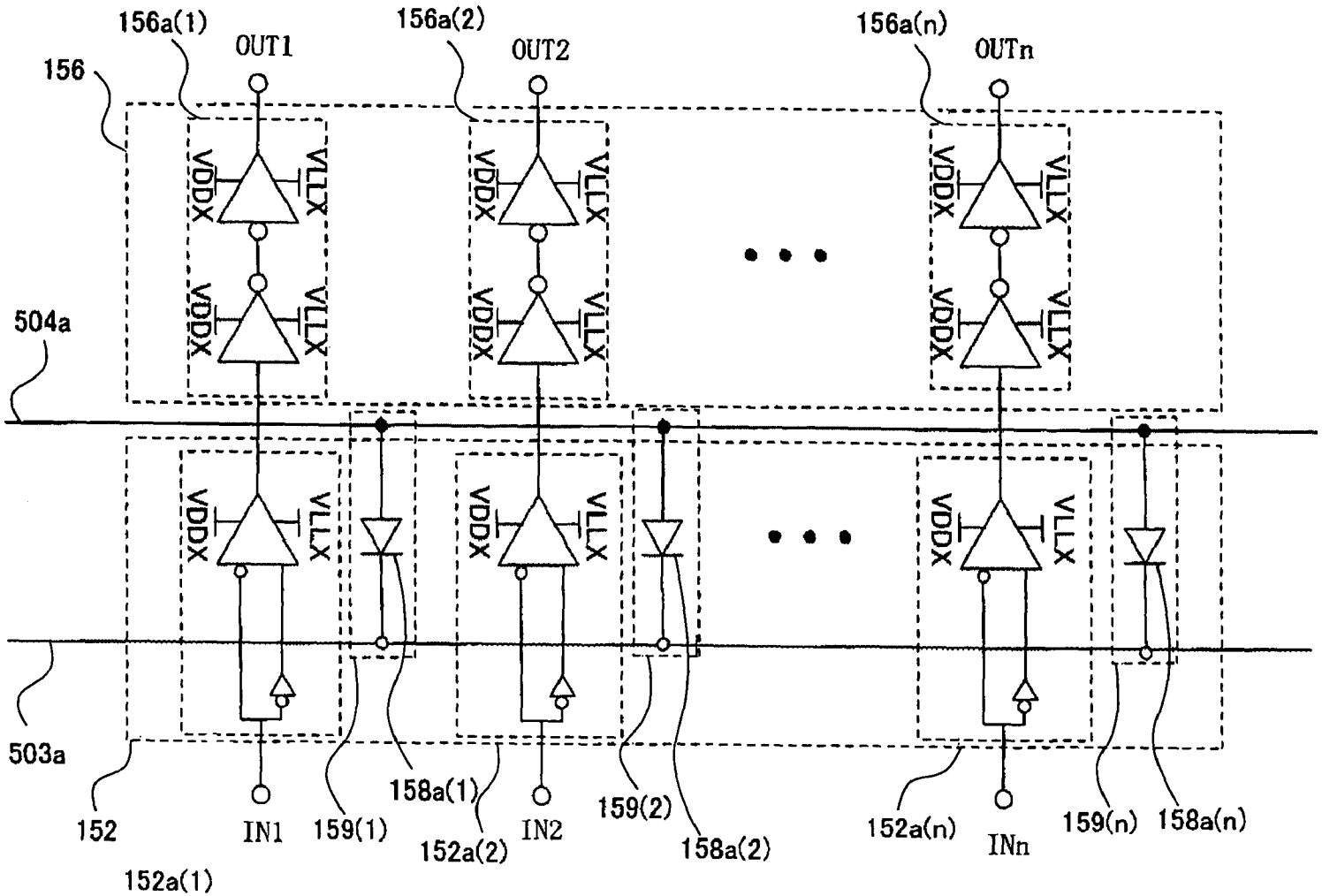
FIG. 4 is a block diagram showing a portion of the data line driving circuit included in the organic EL display device according to the first embodiment of the invention.

In FIGS. 3 and 4, essential parts of the data line driving circuit 150 are an X-side shift register 151, an X-side level shifter 152, an X-side buffer 156, and a latch or sampling circuit 201.

An X clock signal XCK, an inversion X clock signal XCKB, and an X transfer start pulse DX are input from the timing generator 400 to an X-side shift register 151. When the X transfer start pulse DX is input, the X-side shift register 151 sequentially generates X-side transfer pulses XP1, XP2, XP3, . . . , XPn−1, and XPn in synchronization with the X clock signal XCK and the inversion X clock signal XCKB and supplies them to an X-side level shifter 152. The X-side shift register 151 is formed over n stages so as to correspond to the n data lines 114, and the X-side transfer pulses XP1, XP2, XP3, . . . , XPn−1, and XPn are sequentially output from the respective stages in a direction from a first stage to an n-th stage. In addition, from a final stage of the X-side shifter register 151, the X-side transfer pulse XPn is also output as an X-side end pulse XEP of the X-side shift register 151.

The x-side level shifter 152 shifts voltage levels of the X-side transfer pulses XP1, XP2, XP3, . . . , XPn−1, and XPn received from the X-side shift register 151, respectively and outputs them as X-side driving signals X1, X2, X3, . . . , Xn−1, and Xn, respectively.

The latch or sampling circuit 201 latches or samples the image signals supplied from the image signal processing circuit at timings at which the X-side driving signals X1, X2, X3, . . . , Xn−1, and Xn are output from the X-side level shifter 152, respectively. In such a manner, the latched or sampled image signals are sequentially supplied from the data line driving circuit 150 to the data lines 114.

In addition, as described later with reference to FIG. 4, each stage of the X-side level shifter 152 is shown as a voltage amplifying circuit 152*a*(*j*) (j=1, 2, . . . , n) which shifts a voltage level of each of the X-side transfer pulses XP1, XP2, XP3, . . . , XPn−1, and XPn input to the respective stages.

The X-side buffer 156 arranges the waveforms of the X-side driving signals X1, X2, X3, . . . , Xn−1, and Xn output from the X-side level shifter 152 and supplies them to the latch circuit or sampling circuit 201. Each stage of the X-side buffer 156 is shown as a buffer circuit 156*a*(*j*) (j=1, 2, . . . , and n) which is connected to the voltage amplifying circuit 152*a*(*j*).

As power supplies for driving the data line driving circuit 150, there are four power supplies supplied from the power supply circuit 500 shown in FIG. 1 (a first X-side power supply VHHX, a second X-side power supply VDDX, a third X-side power supply VSSX, and a fourth X-side power supply VLLX). The four power supplies supplied from the power supply circuit 500 are supplied to the data line driving circuit 150 through an X-side power supply line group 510*a* including a first X-side power supply line 501*a*, a second X-side power supply line 502*a*, a third X-side power supply line 503*a*, and a fourth X-side power supply line 504*a*. In addition, the four power supplies are in an ascending order of the first X-side power supply VHHX, the second X-side power supply VDDX, the third X-side power supply VSSX, and the fourth X-side power supply VLLX. The manners which associate the four power supplies to the four power supply lines for power supplies are different from one another according to the design of the driving circuit.

The X-side shift register 151 is electrically connected to the first X-side power supply line 501*a* and the second X-side power supply line 502*a*. Therefore, each of the X-side transfer pulses XP1, XP2, XP3, . . . , XPn−1, and XPn has a voltage between the potentials of the power supplies supplied from the first X-side power supply line 501*a* and the second X-side power supply line 502*a*, respectively. In the present embodiment, for example, the firs X-side power supply line 501*a* supplies the second X-side power supply VDDX and the second X-side power supply line 502*a* supplies the third X-side power supply VSSX. Specifically, each voltage of the X-side transfer pulses XP1, XP2, XP3, . . . , XPn−1, and XPn is a voltage between potentials of the second X-side power supply VDDX and third X-side power supply VSSX.

As described in detail later, the power supplies supplied from the first X-side power supply line 501*a* and second X-side power supply line 502*a* may be power supplies having different potentials among the four power supplies. For example, there is a case that the first X-side power supply line 501*a* supplies the first X-side power supply VHHX and the second X-side power supply line 502*a* supplies the second X-side power supply VDDX. However, the power supplies supplied from the first X-side power supply line 501*a* and the second X-side power supply line 502*a* are determined while considering the combination with the power supply for driving the voltage amplifying circuit 152*a*(*j*) (j=1, 2, . . . , and n) included in the X-side level shifter 152.

The X-side level shifter 152 is driven by the power supplies supplied from the third X-side power supply line 503*a* and the fourth X-side power supply line 504*a* among the power supplies supplied from the power supply circuit 500. The voltages of the X-side transfer pulses XP1, XP2, XP3, . . . , XPn−1, and XPn are shifted to voltage levels between the potentials of the third and fourth X-side power supply lines 503*a* and 504*a* and are output as the X-side driving signals X1, X2, X3, . . . , Xn−1, and Xn. In the present embodiment, for example, the third X-side power supply line 503*a* supplies the second X-side power supply VDDX and the fourth X-side power supply line 504*a* supplies the fourth X-side power supply VLLX. Specifically, the voltages of the X-side transfer pulses XP1, XP2, XP3, . . . , XPn−1, and XPn are shifted from voltages between the potentials of the second X-side power supply VDDX and the third X-side power supply VSSX to voltages between the potentials of the second X-side power supply VDDX and the fourth X-side power supply VLLX and are output as the X-side driving signals X1, X2, X3, Xn−1, and Xn.

In addition, a diode 158(*j*) (j=1, 2, . . . , and n) is provided for each voltage amplifying circuit 152*a*(*j*) constituting the X-side level shifter 152. In the present embodiment, the third X-side power supply line 503*a* which is an example of 'one power supply line' according to the invention supplies the second X-side power supply VDDX and the fourth X-side power supply line 504*a* which is an example if 'the power supply lines' according to the invention supplies the fourth X-side power supply VLLX. As a result, the diode 158(*j*) and the voltage amplifying circuit 152*a*(*j*) are connected in parallel between the third and fourth X-side power supply lines 503*a* and 504*a* which supply the power supplies to drive the X-side level shifter 152.

The X-side buffer 156*a*(*j*) constituting each stage of the X-side buffer 156 is driven by the power supplies supplied through the third and fourth X-side power supply lines 503*a* and 504*a*, similarly to the voltage amplifying circuit 152*a*(*j*). In the present embodiment, the third X-side power supply line 503*a* supplies the second X-side power supply VDD and the fourth X-side power supply line 504*a* supplies the fourth X-side power supply VLLX. Therefore, the X-side buffer 156*a*(*j*) is also driven by the second and fourth X-side power supplies VDDX and VLLX, similarly to the voltage amplifying circuit 152*a*(*j*).

The diode 158*a*(*j*) is provided between the third and fourth X-side power supply lines 503*a* and 504*a* and forms a current path 159(*j*) (j=1, 2, . . . , and n) through which static electricity generated at one of the third and fourth X-side power supply lines 503*a* and 504*a* is released into other power supply lines. By providing the current path 159(*j*), electrostatic breakdown of the amplifying circuit 152*a*(*j*) and the buffer 156*a*(*j*) included in the X-side level shifter 152 due to the static electricity generated at one power supply line of the third and fourth X-side power supply lines 503*a* and 504*a* can be prevented.

In the present embodiment, the plurality of diodes 158*a*(*j*) are provided in parallel between the third and the fourth X-side power supply lines 503*a* and 504*a*. As a result, even if static electricity is generated at the power supply line located near the voltage amplifying circuit 152*a*(*j*) constituting each stage of the X-side level shifter 152, it is possible to discharge the static electricity fast via the current path 159(*j*) (j=1, 2, . . . , and n) formed by the plurality of diodes 158*a*(*j*). Specifically, the current path 159(*j*) corresponds to 'an electrostatic protecting circuit' according to the invention.

In addition, the diode 158*a*(*j*) is not provided in the X-side level shifter 152 and is included in the X-side inter-power supply protecting circuit 155. Specifically, FIG. 4 shows an electrical connection state between the diode 158*a*(*j*) and the voltage amplifying circuit 152*a*(*j*), and the diode 158*a*(*j*) is provided at the outside of the X-side level shifter 152. When an inconsistency is generated at one diode among the plurality of diodes 156*a*(*j*) which are connected in parallel between the third and fourth X-side power supply lines 503*a* and 504*a*, the current path is ensured by other diodes, thereby suppressing the electrostatic breakdown of the X-side level shifter 152. In addition, since the electrostatic breakdown of the X-side level shifter 152 can be suppressed, the electrostatic breakdown of the X-side shift register 151 which is electrically connected to the X-side level shifter 152 can be suppressed. As a result, it is possible to protect the overall data line driving circuit 150 from the static electricity.

In the present embodiment, the diodes 158*a*(*j*) are provided so as to correspond to the voltage amplifying circuits 152*a*(*j*), respectively. However, the diode constituting the current path may be provided so as to correspond to a voltage amplifying circuit group having the plurality of voltage amplifying circuits 152*a*(*j*). Even if an inconsistency is generated at the diode which is provided in parallel to one voltage amplifying circuit group, it is possible to release the static electricity generated at the power supply line through other diodes which are provided in parallel to other voltage amplifying circuits. According to this configuration, the number of the diodes can be reduced as compared to the case in which the diode 158*a*(*j*) is provided for each voltage amplifying circuit 152*a*(*j*). In addition, the current path can be ensured.

In the organic EL display device 1, when the organic EL panel 100 is assembled or transported, that is, when the organic EL panel 100 is in a non-operation state or in an operation state with power supplied, there is a case in which static electricity is generated at the driving circuit 120 or various wiring lines connected to the driving circuit 120. When the static electricity is applied to the X-side shift register 151, the X-side level shifter 152, and the buffer 156 constituting the data line driving circuit 150 among the driving circuit 120, there is a case that all or a part of the X-side shift register 151, the X-side level shifter 152, and the buffer 156 are broken. In addition, there is a possibility that the elements of the driving circuit become deteriorate even if all of the X-side shift register 151, the X-side level shifter 152, and the buffer are not broken. Particularly, the power supply lines included in the X-side power supply line group 510*a* may generate the static electricity at a manufacturing process for forming the power supply lines. The X-side inter-power supply protecting circuit 155 including the current path 159 (*j*), which is an example of 'an electrostatic protecting circuit' according to the invention, is provided with respect to the X-side power supply line group 510*a*. As a result, it is possible to release the static electricity generated at one power supply line to other power supply lines and thus to prevent the electrostatic breakdown of the driving circuit 120.

In the data line driving circuit 150, the protecting circuit may be provided with respect to at least one of an input terminal side of the data line driving circuit 150 where the signal is input from the outside and an output terminal side of the data line driving circuit 150 where the signal is output to the output. For example, as shown in FIG. 3, the data line driving circuit 150 may have an X-side input protecting circuit provided with respect to the input terminal side of the data line driving circuit 150 and an X-side output protecting circuit provided with respect to the output terminal side of the data line driving circuit 150, in addition to the X-side inter-power supply protecting circuit 155 provided with respect to the X-side power supply line group 510*a*. In detail, in FIG. 3, the X-side input protecting circuit may be provided with respect to the signal lines to which the X clock signal XCK, the inverting X clock signal XCKB, and the X transfer start pulse DX are input. The X-side output protecting circuit may be provided with respect to the signal line through which the X-side end pulse XEP is output or may be provided with respect to the signal lines through which the X-side driving signals X1, X2, X3, . . . , Xn−1 and Xn are output.

In addition, the X-side inter-power supply protecting circuit 155 can perform power supply through the current path 159(*j*) such that level relationship between four potentials in the X-side power supply line group 510*a* is maintained according to predetermined relationship, even when the organic EL panel 100 is driven. That is, even when the organic EL panel 100 is driven, the data line driving circuit 150 can be operated without being influenced by the power supply of the X-side inter-power supply protecting circuit 155.

In the present embodiment, the data line driving circuit is mainly described. However, the configuration of the driving circuit of the electro-optical panel according to the invention is not limited to the data line driving circuit, but may be applied to the scanning line driving circuit for supplying the scanning signals to the electro-optical panel. Therefore, by installing the diode in the scanning line driving circuit, it is possible to discharge the static electricity generated at the scanning line driving circuit to the outside and thus to protect the scanning line driving circuit from the static electricity.

Second Embodiment

Next, a driving circuit of an organic EL panel according to a second embodiment of the invention will be described with reference to FIG. 5. In addition, organic EL display devices according to second to fourth embodiments have the same configuration as that of the organic EL display device according to the first embodiment, except for locations where diodes are connected. Therefore, the same elements as those of the first embodiment are represented by the same reference numerals. In addition, in the second to fourth embodiments, only any stage of stages constituting an X-side shift register, an X-side level shifter, and an X-side buffer will be described.

An electrostatic protecting circuit included in the driving circuit of the organic EL display device according to the second embodiment supplies a current path for releasing a static electricity with respect to both an X-side shift register and an X-side level shifter by using diodes 167*a*(*j*) provided between power supply lines to supply power supplies for driving the X-side shift register and diodes 168*a*(*j*) provided between power supply lines to supply power supplies for driving the X-side level shifter. FIG. 5 is a block diagram showing one of the stages of the X-side shift register 151, the X-side level shifter 152, and the X-side buffer 156 shown in FIG. 2.

Figure 5:
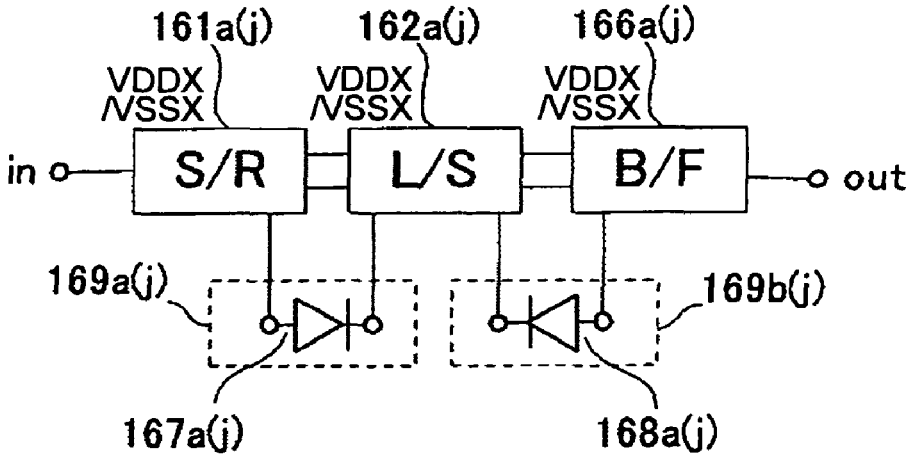
FIG. 5 is a block diagram showing a portion of a driving circuit according to a second embodiment of the invention.

In FIG. 5, each stage S/R 161*a*(*j*) (j=1, 2, . . . , and n) constituting the X-side shift register 151 included in the data line driving circuit 150, each stage L/S 162*a*(*j*) (j=1, 2, . . . , and n) included in the X-side level shifter 152, and an X-side buffer B/F 166*a*(*j*) (j=1, 2 . . . , and n) are connected to one another in an order of the S/R 161*a*(*j*), the L/S 162*a*(*j*), and the B/F 166*a*(*j*) from an input side of a data line driving circuit.

The S/R 161*a*(*j*) is driven by a second X-side power supply VDDX supplied from a first X-side power supply line 501*a* and a third X-side power supply VSSX supplied from a second X-side power supply line 502*a*. The L/S 162*a*(*j*) and the B/F 166*a*(*j*) are driven by a second X-side power supply VDDX supplied from a third X-side power supply line 503*a* and a fourth X-side power supply VLLX supplied from a fourth X-side power supply line 504*a*. Specifically, in the present embodiment, the third X-side power supply line 503*a* corresponds to 'one power supply line' according to the invention and the fourth X-side power supply line 504*a* corresponds to 'another power supply line' according to the invention.

The diode 167*a*(*j*) and the diode 168*a*(*j*) which are an example of 'a diode' according to the invention constitute the current paths 169*a*(*j*) and 169*b*(*j*) for releasing the static electricity.

The diode 167*a*(*j*) is electrically connected in parallel to the S/R 161*a*(*j*) between the two power supply lines for supplying the second X-side power supply VDDX and the third X-side power supply VSSX to the S/R 161*a*(*j*). In the present embodiment, two power supply lines for supplying the second X-side power supply VDDX and the third X-side power supply VSSX are the first X-side power supply line 501*a* and the second X-side power supply line 502*a*. In addition, the diode 167*a*(*j*) constitutes the current path 168*a*(*j*) to release the static electricity generated at one of the two power supply lines to the other power supply line, thereby protecting the S/R 161*a*(*j*) from the static electricity.

The diode 168*a*(*j*) is electrically connected in parallel to the L/S 162*a*(*j*) between the two power supply lines for supplying the second X-side power supply VDDX and the fourth X-side power supply VLLX to the L/S 162$a(j)$. The two power supply lines for supplying the second X-side power supply VDDX and the fourth X-side power supply VLLX are the third X-side power supply line 503$a$ and the fourth X-side power supply line 504$a$. In addition, the diode 168$a(j)$ constitutes the current path 169$a(j)$ to release the static electricity generated at one of the two power supply lines to the other power supply line, thereby protecting the L/S 162$a(j)$ from the static electricity. In addition, in the present embodiment, since the S/R 161$a(j)$ and the L/S 162$a(j)$, and the L/S 162$a(j)$, and the B/F 166$a(j)$ commonly use the power supply lines, respectively, it is possible to release the static electricity generated at any one of the first X-side power supply line 501$a$, the second X-side power supply line 502$a$, the third X-side power supply line 503$a$, and the fourth X-side power supply line 504$a$ to other power supply lines. In detail, when the static electricity having potential higher than that of the second X-side power supply VDDX is applied to the fourth X-side power supply line 504$a$ for supplying the power supply from the fourth X-side power supply VLLX, the current path 169$a(j)$ including the diode 168$a(j)$ discharges the static electricity from the fourth X-side power supply line 504$a$ to the third X-side power supply line 503$a$. In addition, when the static electricity having potential lower than that of the fourth X-side power supply VLLX is applied to the third X-side power supply line 503$a$ for supplying the power supply from the second X-side power supply VDDX, the current path 169$a(j)$ including the diode 168$a(j)$ discharges the static electricity from the third X-side power supply line 503$a$ to the fourth X-side power supply line 504$a$.

Therefore, in the case in which the static electricity is applied to the third X-side power supply line 503$a$ and the fourth X-side power supply line 504$a$, when the static electricity having the potential lower than that of the current path is applied thereto, an undesired voltage generated between the third and fourth X-side power supply lines 503$a$ and 504$a$ can be dispersed and removed through the current path including the diode 168$a(j)$. Similarly, since a current path 169$a(j)$ is formed between the first and second X-side power supply lines 501$a$ and 502$a$ by the diode 167$a(j)$, it is possible to discharge an undesired voltage due to the static electricity generated at the first and second X-side power supply lines 501$a$ and 502$a$ through the current path 169$a(j)$. Therefore, by providing the diode 167$a(j)$ and the diode 168$a(j)$, it is possible to protect all of the S/R 161$a(j)$, the L/S 162$a(j)$ and the B/F 166$a(j)$ from the static electricity.

Third Embodiment

Figure 6:
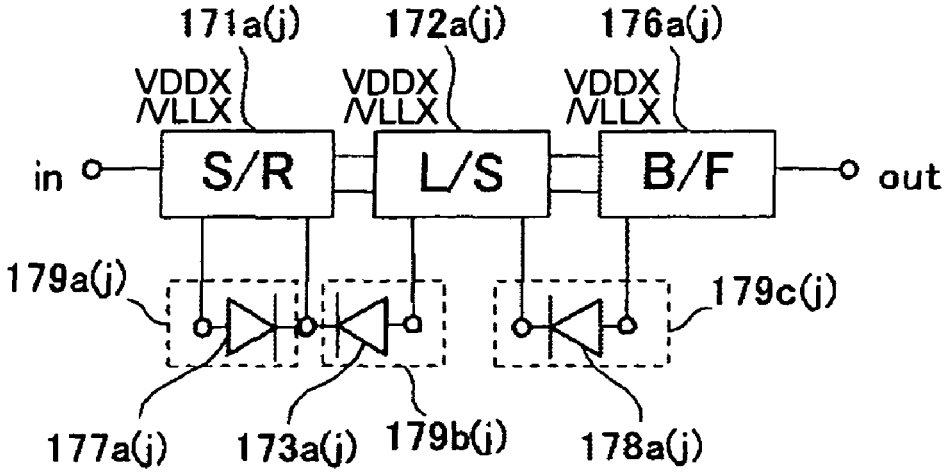
FIG. 6 is a block diagram showing a portion of a driving circuit according to a third embodiment of the invention.

Next, a driving circuit of an organic EL panel according to a third embodiment of the invention will be described with reference to FIG. 6. FIG. 6 is a block diagram showing a portion of the driving circuit according to the third embodiment. The driving circuit of the organic EL panel according to the present embodiment is a modification of the driving circuit of the organic EL panel according to the second embodiment, in which a current path is provided between three power supply lines for supplying power supplies to an X-side shift register and an X-side level shifter and static electricity generated at one power supply line of three power supply lines can be released to other power supply lines.

In FIG. 6, each stage SIR 171$a(j)$ constituting an X-side shift register included in the driving circuit, each stage L/S 172$a(j)$ included in an X-side level shifter, and each stage B/F 176$a(j)$ of an X-side buffer are electrically connected to each other in an order of the S/R 171$a(j)$, the L/S 172$a(j)$, and the B/F 176$a(j)$ from an input side of a data line driving circuit. Therefore, various signals input from a timing generator and an image signal processing circuit to the driving circuit are transferred as transfer pulses from the SIR 171$a(j)$ to the L/S 172$a(j)$ at predetermined timings, and the transfer pulses are output through the B/F 176$a(j)$ as driving signals whose voltage levels are shifted by the L/S 172$a(j)$.

The S/R 171$a(j)$ is driven by a second X-side power supply VDDX and a third X-side power supply VSSX. A first X-side power supply line 501$a$ supplies a second X-side power supply VDDX to the S/R 171$a(j)$, and a second X-side power supply line 502$a$ supplies a third X-side power supply VSSX to the S/R 171$a(j)$. Between the first X-side power supply line 501$a$ and the second X-side power supply line 502$a$, a diode 177$a(j)$ is electrically connected in parallel to the S/R 171$a(j)$. In addition, the diode 177$a(j)$ constitutes a current path 179$a(j)$ which discharges the static electricity generated at one of the first X-side power supply line 501$a$ and the second X-side power supply line 502$a$ to the other power supply line.

An anode of the diode 177$a(j)$ is electrically connected to the second X-side power supply line 502$a$ and a cathode thereof is electrically connected to the first X-side power supply line 501$a$. Therefore, when the static electricity having potential higher than that of the second X-side power supply VDDX is applied to the second X-side power supply line 502$a$ to which the power supply is supplied from the third X-side power supply VSSX, the diode 177$a(j)$ discharges the static electricity the from the second X-side power supply line 502$a$ to the first X-side power supply line 501$a$. When the static electricity having potential lower than that of the third X-side power supply VSSX is applied to the first X-side power supply line 501$a$ to which the power supply is supplied from the second X-side power supply VDDX, the diode 177$a(j)$ discharges the static electricity from the first X-side power supply line 501$a$ to the second X-side power supply line 502$a$. By providing the diode 177$a(j)$, it is possible to discharge the static electricity generated at one of the first X-side power supply line 501$a$ and the second X-side power supply line 502$a$ and thus to protect the S/R 171$a(j)$ from the static electricity.

The L/S 172$a(j)$ are driven by the first X-side power supply VHHX and the third X-side power supply VSSX. The third X-side power supply line 503$a$ supplies the first X-side power supply VHHX to the L/S 172$a(j)$, and the fourth X-side power supply line 504$a$ supplies the third X-side power supply VSSX to the L/S 172$a(j)$. Between the third X-side power supply line 503$a$ and the fourth X-side power supply line 504$a$, the diode 178$a(j)$ is electrically connected in parallel to the L/S 172$a(j)$. The diode 178$a(j)$ forms the current path 179$c(j)$ to discharge the static electricity generated at one of the third X-side power supply line 503$a$ and the fourth X-side power supply line 504$a$ to the other power supply line.

In addition, the second X-side power supply line 502$a$ for supplying the third X-side power supply VSSX to the S/R 171$a(j)$ and the fourth X-side power supply line 504$a$ for supplying the third X-side power supply VSSX to the L/S 172$a(j)$ supply the third X-side power supply VSSX. Therefore, the current path 179$b(j)$ for discharging the static electricity at any of the first, second and third X-side power supply lines 501$a$, 502$a$ and 503$a$ is formed by the diode 173$a(j)$. Therefore, by providing the diodes 177$a(j)$, 173$a(j)$ and 178$a(j)$, it is possible to protect the S/R 171$a(j)$ and the L/S 172$a(j)$ from the static electricity generated at any of the three power supply lines.

The B/F 176$a(j)$ is driven by the first X-side power supply VHHX and the third X-side power supply VSSX. The third X-side power supply line 503$a$ supplies the first X-side power supply VHHX to the B/F 176$a(j)$ and the fourth X-side power supply line 504*a* supplies the third X-side power supply VSSX to the B/F 176*a*(*j*). Between the third X-side power supply line 503*a* and the fourth X-side power supply line 504*a*, the diode 179*c*(*j*) is electrically connected in parallel to the B/F 176*a*(*j*). The diode 179*c*(*j*) forms the current path 178*a*(*j*) to discharge the static electricity generated at one of the third X-side power supply line 503*a* and the fourth X-side power supply line 504*a* to the other power supply line. Therefore, by providing the diode 179*c*(*j*), it is possible to protect the L/S 172*a*(*j*) and the B/F 176*a*(*j*) from the static electricity generated at one of the third X-side power supply line 503*a* and the fourth X-side power supply line 504*a*.

In such a manner, it is possible to disperse the static electricity generated at the first X-side power supply line 501*a*, the second X-side power supply line 502*a*, the third X-side power supply line 503*a* and the fourth X-side power supply line 504*a* by the diodes 177*a*(*j*), 178*a*(*j*) an 179*a*(*j*) and to remove it. Therefore, even when an undesired voltage is generated between the power supply lines, it is possible to protect the entire driving circuit including the X-side level shifter, the X-side buffer, and the X-side shift register from the undesired voltage generated due to the static electricity or the like.

Fourth Embodiment

Figure 7:
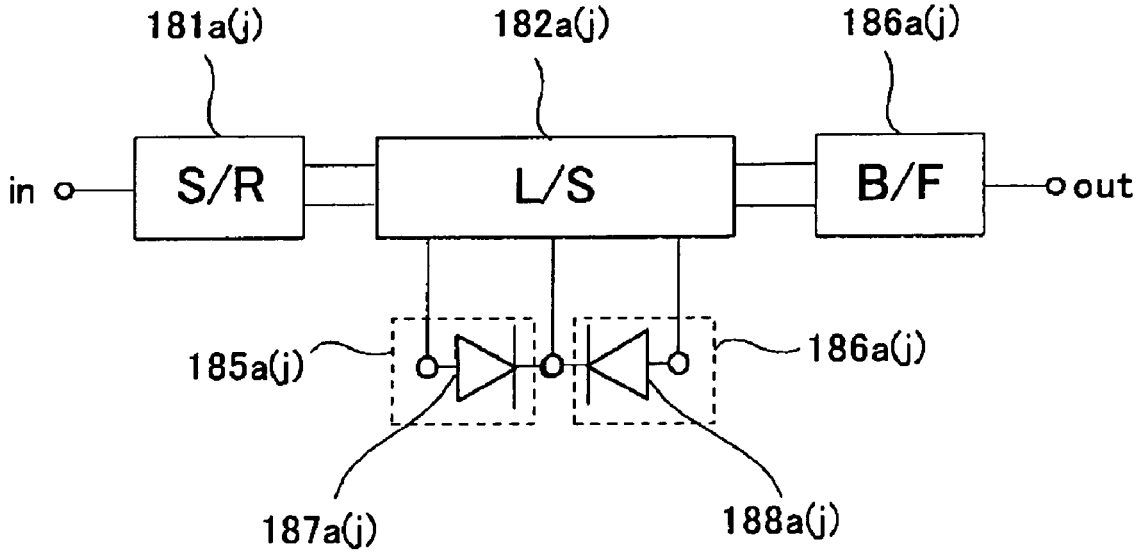
FIG. 7 is a block diagram showing a portion of a driving circuit according to a fourth embodiment of the invention.

Next, a driving circuit of an organic EL panel according to a fourth embodiment of the invention will be described with reference to FIG. 7. FIG. 7 is a block diagram showing a part of the driving circuit of the organic EL panel according to the fourth embodiment. In the driving circuit of the organic EL panel according to the fourth embodiment, each stage constituting an X-side level shifter to drive the organic EL panel is driven by three power supply lines among four power supply (a first X-side power supply VHHX, a second X-side power supply VDDX, a third X-side power supply VSSX and a fourth X-side power supply VLLX). By providing a current path between three power supply lines, it is possible to disperse static electricity generated at the three power supply lines and to remove it. In addition, either the first X-side power supply line 501*a* or the second X-side power supply line 502*a* for supplying the power supplies to the X-side shift register 502*a* to supply the three types of power supplies to the X-side level shifter 162 is commonly used as a power supply line for supplying the power supply to the X-side level shifter 151.

In FIG. 7, each stage L/S 182*a*(*j*) constituting an X-side level shifter 152 is driven by a first X-side power supply VHHX, a second X-side power supply VDDX and a third X-side power supply VSSX. In the fourth embodiment, for example, a third X-side power supply line 503*a* supplies the first X-side power supply VHHX to the L/S 182*a*(*j*) and a fourth X-side power supply line 504*a* supplies the third X-side power supply VSSX to the L/S 182*a*(*j*). An X-side driving signal transmitted from the L/S 182*a*(*j*) to the X-side buffer B/F 186*a*(*j*) is shifted to a voltage level between potentials of the first X-side power supply VHHX and the third X-side power supply VSSX by the L/S 182*a*(*j*). In addition, the second X-side power supply VDDX is also supplied to the L/S 182*a*(*j*). As a power supply line for supplying the second X-side power supply VDDX to the L/S 182*a*(*j*), for example, a power supply line for supplying a power to the S/R 181*a*(*j*) is commonly used.

Between the third X-side power supply line 503*a* to supply the first X-side power supply VHH and the fourth X-side power supply line 504*a* to supply the third X-side power supply VSSX, a diode 187*a* (*j*) is provided. An anode of the diode 187*a*(*j*) is electrically connected to the fourth X-side power supply line 504*a* and a cathode thereof is electrically connected to the third X-side power supply line 503*a*. Therefore, the diode 187*a*(*j*) constitutes a current path 185*a*(*j*) which discharges the static electricity generated at any of the third X-side power supply line 503*a* and the fourth X-side power supply line 504*a*.

When the static electricity having potential higher than that of the first X-side power supply VHHX is applied to the fourth X-side power supply line 504*a*, the diode 187*a*(*j*) discharges the static electricity from the fourth X-side power supply line 504*a* to the third X-side power supply line 503*a*. When the static electricity having potential lower than that of the third X-side power supply VSSX is applied to the third X-side power supply line 504*a*, the diode 187*a*(*j*) discharges the static electricity from the third power supply line 503*a* to the fourth X-side power supply line 504*a*. Therefore, by providing the diode 187*a*(*j*), the electrostatic breakdown of the X-side level shifter due to the static electricity generated at the power supply lines for supplying the power supplies to drive the X-side level shifter can be prevented.

The diode 188*a*(*j*) is electrically connected between the power supply line for supplying the second X-side power supply VDDX and the third X-side power supply line 503*a* for supplying the first X-side power supply VHHX. Similar to the diode 187*a*(*j*), the diode 188*a*(*j*) forms the current path 186*a*(*j*) to discharge the static electricity generated at the two power supply lines.

Therefore, by providing the diodes 187*a*(*j*) and 188*a*(*j*), it is possible to prevent the L/S 182*a*(*j*) from being broken due to the static electricity generated at the power supply lines in the driving circuit of the L/S 182*a*(*j*) and to prevent the overall driving circuit from being broken due to the static electricity.

Fifth Embodiment

Figure 8:
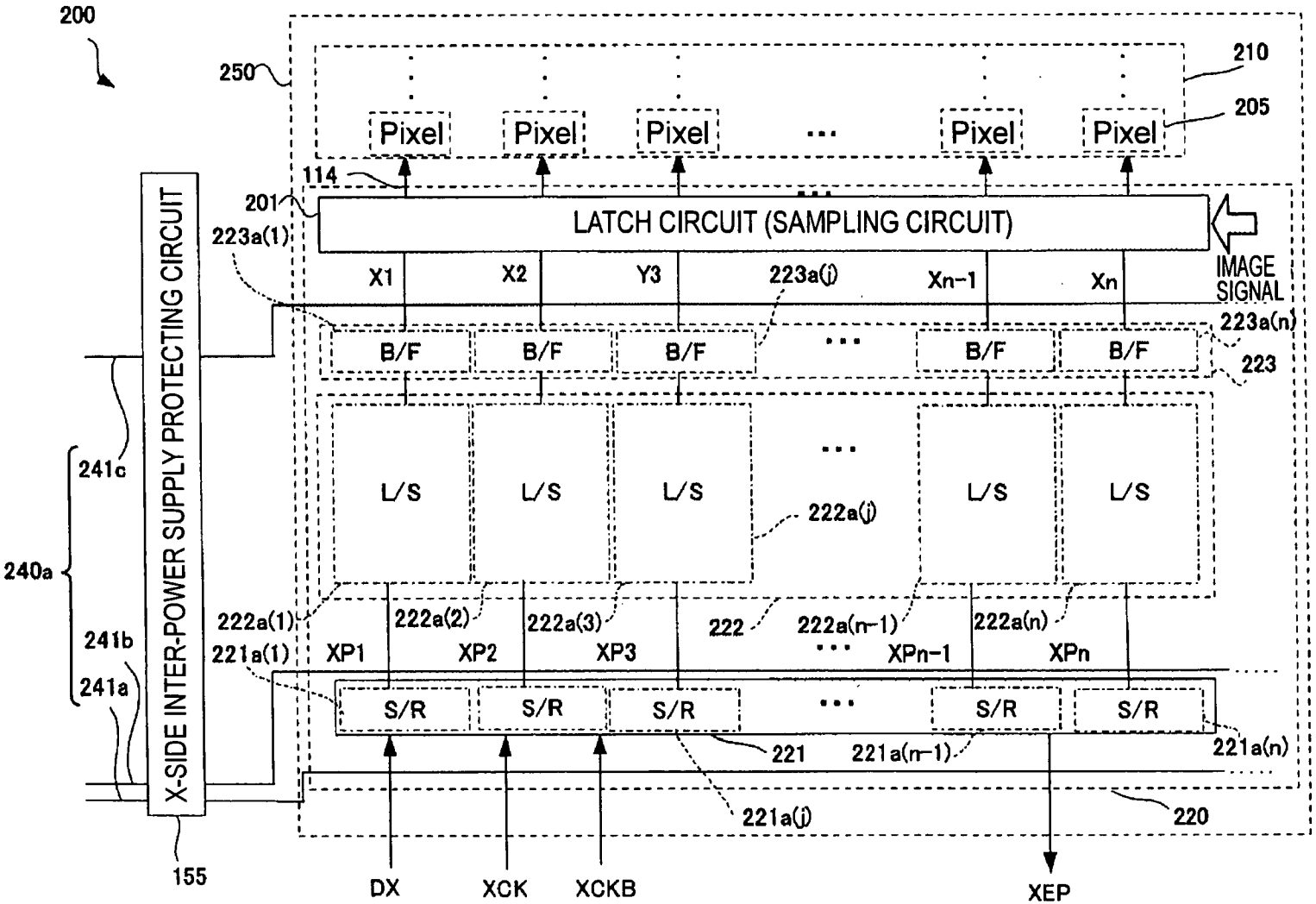
FIG. 8 is a block diagram showing a portion of a driving circuit according to a fifth embodiment of the invention.
Figure 9:
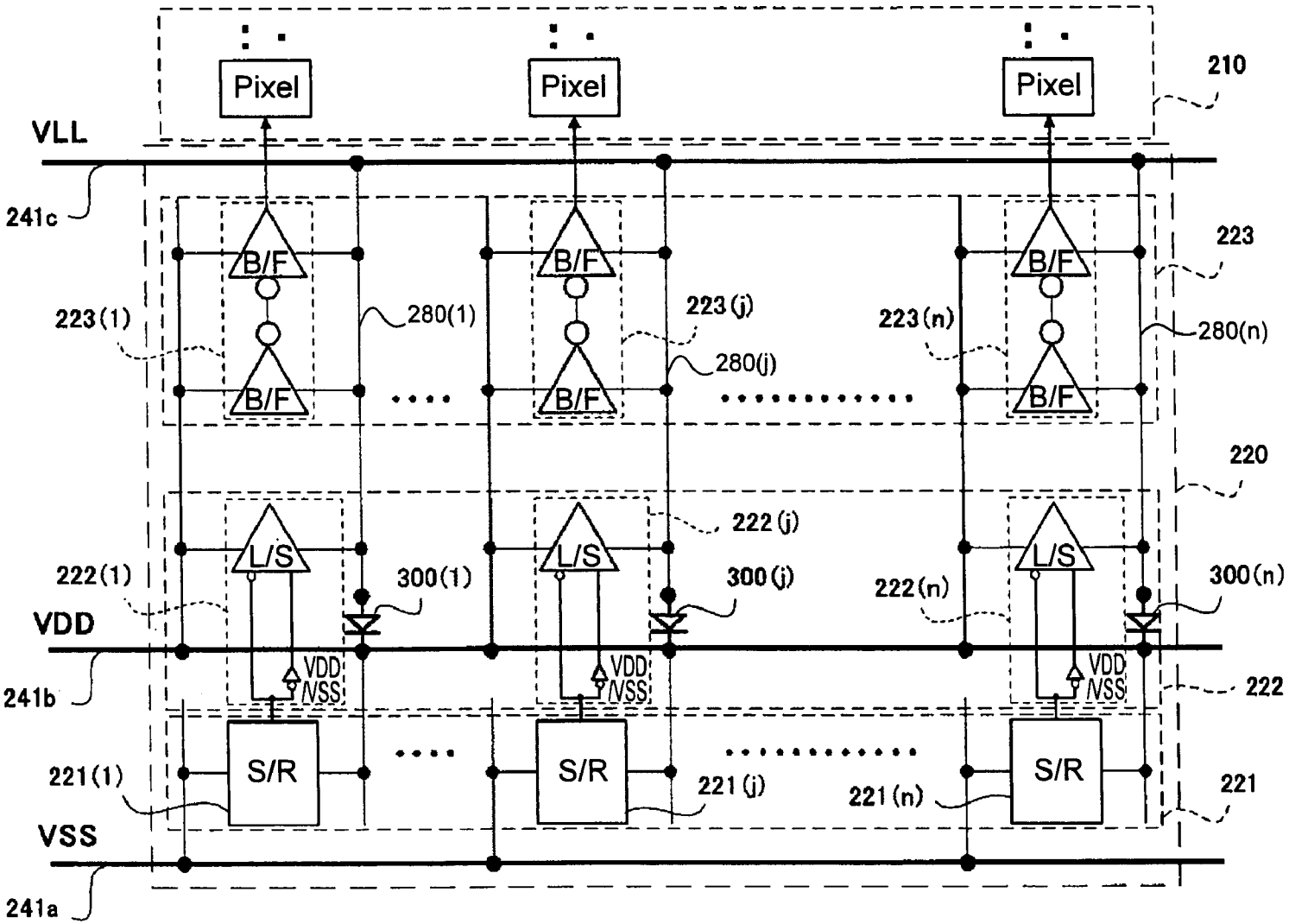
FIG. 9 is a block diagram showing a portion of the driving circuit according to the fifth embodiment of the invention.
Figure 10:
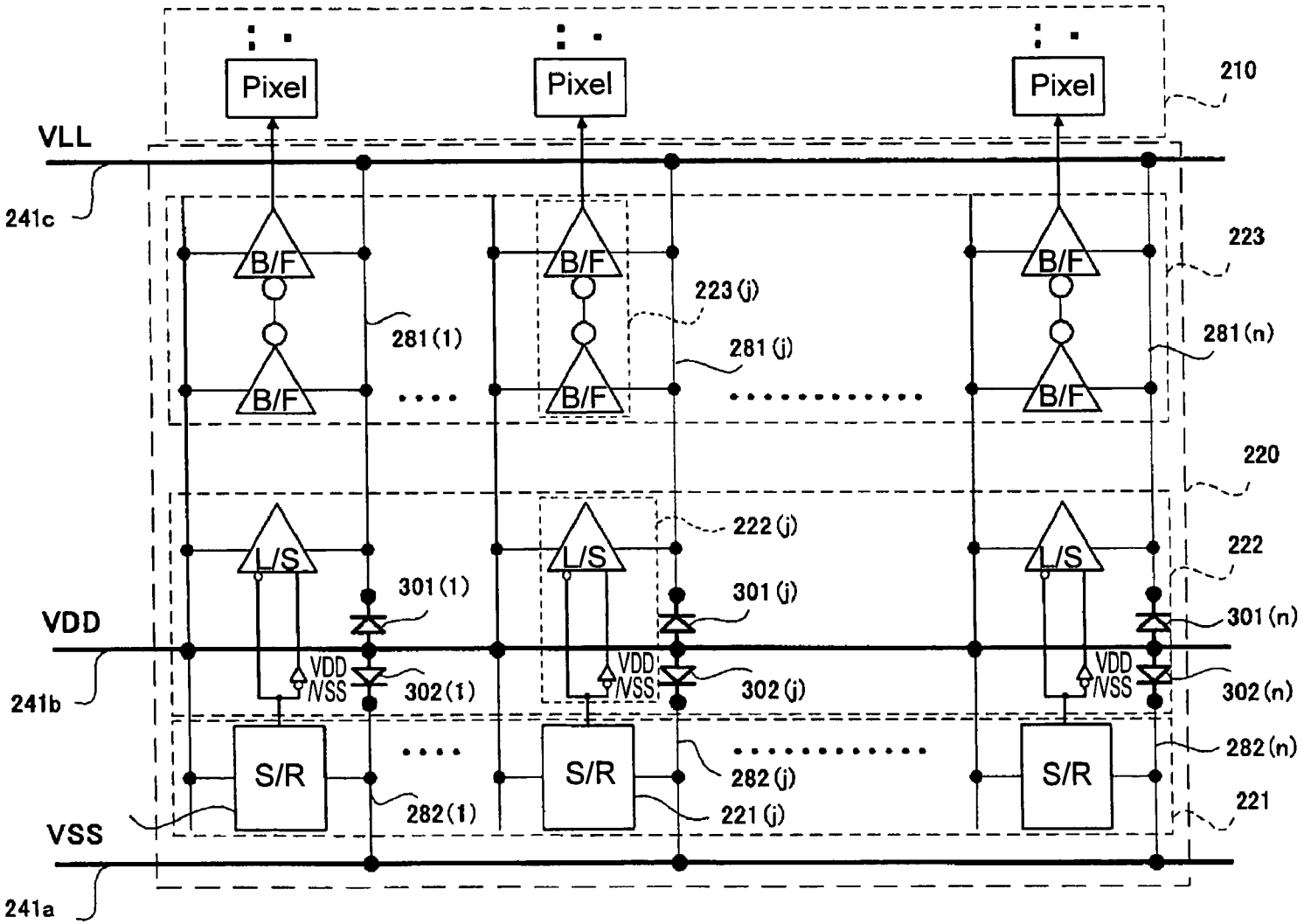
FIG. 10 is a block diagram showing a portion of the driving circuit according to the fifth embodiment of the invention.
Figure 11:
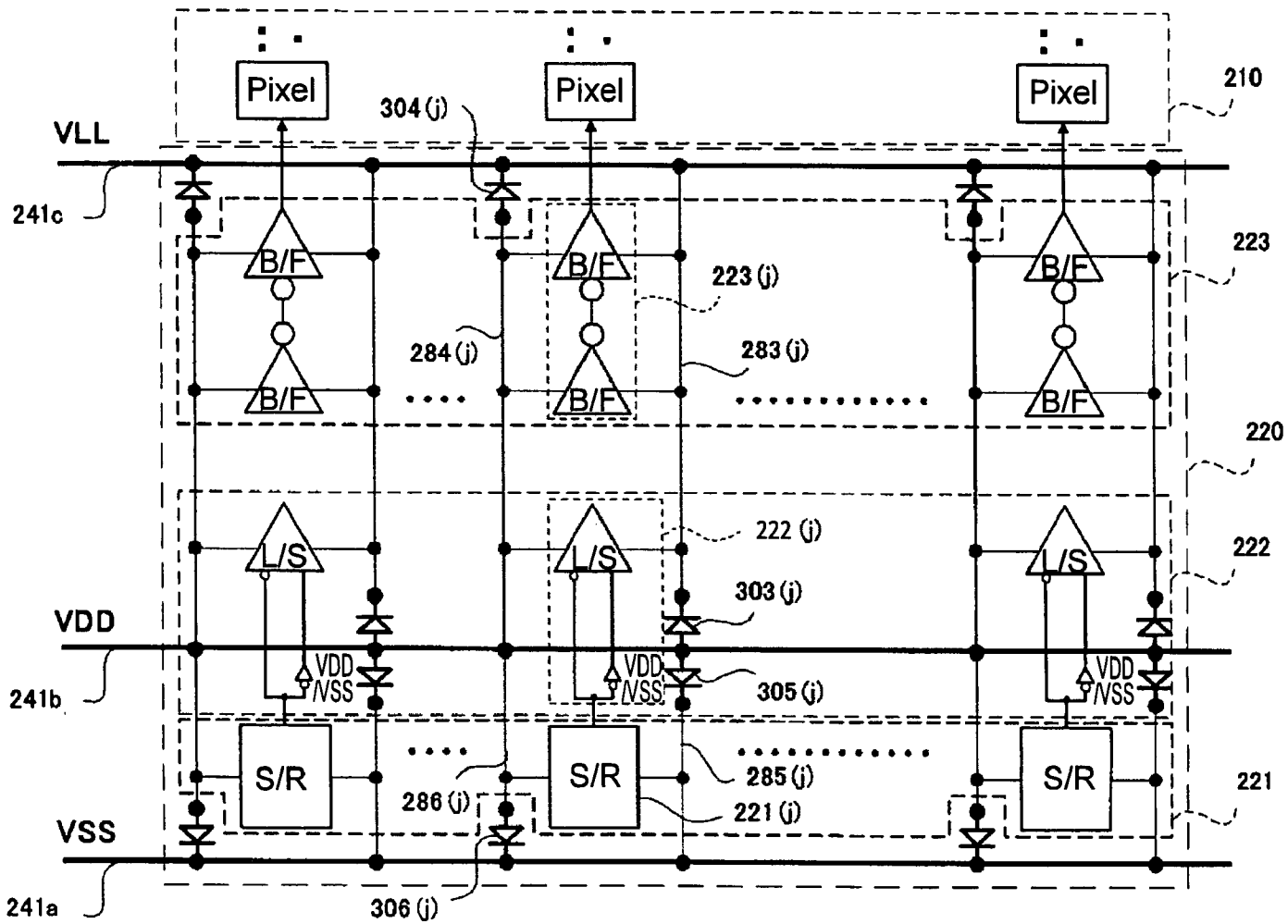
FIG. 11 is a block diagram showing a portion of the driving circuit according to the fifth embodiment of the invention.

Next, a driving circuit according to a fifth embodiment of the invention will be described. FIG. 8 is a schematic diagram showing the configuration of an image display device having the driving circuit of the electro-optical panel according to the fifth embodiment mounted therein. FIGS. 9 to 11 are detailed views showing the arrangement of a protecting circuit included in the driving circuit of the electro-optical panel according to the fifth embodiment. The driving circuit of the electro-optical panel according to the fifth embodiment is similar to the driving circuits of the electro-optical panels shown in the first to fourth embodiments in that various circuits included in the driving circuit can be protected from the static electricity. In FIGS. 8 to 11, a connection state between wiring lines is shown in detail as compared to FIGS. 4 to 7, and the same elements are represented by the same reference numerals.

In FIG. 8, an organic EL display device 200 includes an organic EL display panel 250, an image display region 210 having a plurality of pixel portions 205 arranged in a matrix shape on the organic display panel 250, a data line driving circuit 220, and a power supply line group 240*a* having power supply lines 241*a*, 241*b*, and 241*c*.

The data line driving circuit 220 includes a shift register 221, a level shifter 222 and a buffer 223 which are respectively an example of 'an electronic circuit' according the invention. In addition, the stages 221(*j*), 222(*j*) and 223(*j*) of the shift resister 221, the level shifter 222 and the buffer 223 are respectively an example of 'a unit circuit' according the invention. The power supply lines 241*a*, 241*b*, and 241*c* supply power supplies VDD, VSS, and VHH having different potentials to the data line driving circuit 220. In addition, since the organic EL display device according to the fifth embodiment has the same configuration as that of the organic EL display device illustrated with reference to FIG. 1, the detailed description about the configuration will be omitted.

FIG. 9 is a diagram showing an example of the arrangement of a protecting circuit included in the data line driving circuit 220. The data line driving circuit 220 has power input lines 280(*j*) (j=1, 2, . . . , and n) and an electrostatic protecting diode 300(*j*) (j=1, 2, . . . , and n).

In FIG. 9, through the power input lines 280(*j*), the respective stages of the shift register, the buffer and the level shifter and the power supply lines 241*a*, 241*b*, and 241*c* are electrically connected to each other. In addition, the power input lines 280(*j*) input a power supply VLL from the power supply line 241*c* to the respective stages of the shift register 221, the level shifter 222 and the buffer 223.

The power input line 280(*j*) is provided between the power supply lines 241*b* and 241*c* and extends near the respective stages of the shift register 221, the level shifter 222 and the buffer 223 so as to be branched from the power supply line 241*c*.

The electrostatic protecting diode 300(*j*) is provided in the middle of the power input line 280(*j*) and protects the respective stages of the level shifter 222 and the buffer 223 from static electricity generated at the power supply lines 241*b* and 241*c* or accumulated in the power supply lines 241*b* and 241*c*. Since the electrostatic protecting diode 300(*j*) is provided in the middle of the power input line 280(*j*) for supplying the power supply to the respective stages of the level shifter 222 and the buffer 223, the electrostatic protecting diode 300(*j*) is provided near the respective stages of the level shifter 222 and the buffer 223 as compared to the protecting circuit provided at the exterior of the power input line 280(*j*), for example, in the middle of the power supply line 241*c* or 241*b*. Therefore, it is possible to suitably protect the respective stages of the level shifter 222 and the buffer 223 from the static electricity accumulated in the power supply line 241*c* or 241*b*.

FIG. 10 is a diagram showing another example of the arrangement of a protecting circuit. A data line protecting circuit 220 includes power input lines 281(*j*) (j=1, 2, . . . , and n) and 282(*j*) (j=1, 2, . . . , and n) and an electrostatic protecting diodes 301(*j*) (j=1, 2, . . . , and n) and 302(*j*) (j=1, 2, . . . , and n).

In FIG. 10, the power input line 281(*j*) (j=1, 2, . . . , and n) is provided for each stage of the level shifter 222(*j*) and the buffer 223(*j*) such that it is electrically connected between the power supply lines 241*c* and 241*b*. In addition, the power input line 281(*j*) (j=1, 2, . . . , and n) supplies the power supply VLL to each stage of the level shifter 222(*j*) and the buffer 223(*j*).

The electrostatic protecting diode 301(*j*) is provided in the middle of the power input line provided for each stage of the level shifter 222(*j*) and the buffer 223(*j*) and protects each stage of the level shifter 222(*j*) and the buffer 223(*j*) from the static electricity generated at or accumulated in the power supply lines 241*c* and 241*b*.

The power input line 282(*j*) is provided for each stage of the shift register 221(*j*) such that it is electrically connected between the power supply lines 241*a* and 241*b*. In addition, the power input line 282(*j*) (j=1, 2, . . . , and n) supplies the power supply VSS to each stage of the shift register 221(*j*).

The electrostatic protecting diode 302(*j*) is provided in the middle of the power input line 282(*j*) provided for each stage of the shift register 221(*j*) and protects each stage of the shift register 221(*j*) from the static electricity generated at or accumulated in the power supply lines 241*a* and 241*b*.

The electrostatic protecting diodes 301(*j*) and 302(*j*) are provided near each stage of the shift register 221(*j*), the level shifter 222(*j*) and the buffer 223(*j*) as compared to the protecting circuit provided at the exteriors of the power input lines 281(*j*) and 282(*j*) for supplying the power supply to each stage of the shift register 221(*j*), the level shifter 222(*j*) and the buffer 223(*j*), that is, provided for the power supply line 241*a*, 241*b*, or 241*c*. Therefore, the electrostatic protecting diodes 301(*j*) and 302(*j*) suitably can protect the respective stages of the shift register 221(*j*), the level shifter 222(*j*) and the buffer 223(*j*) from the static electricity accumulated in the power supply line 241*a*, 241*b*, or 241*c*.

FIG. 11 is a diagram showing another example of the arrangement of a protecting circuit. The data line driving circuit 220 includes power input lines 283(*j*) (j=1, 2, . . . , and n), 284(*j*) (j=1, 2, . . . , and n), 285(*j*) (j=1, 2, . . . , and n) and 286(*j*) (j=1, 2, . . . , and n), and electrostatic protecting diodes 303(*j*) (j=1, 2, . . . , and n), 304(*j*) (j=1, 2, . . . , and n), 305(*j*) (j=1, 2, . . . , and n) and 306(*j*) (j=1, 2, . . . , and n).

In FIG. 11, the power input line 283(*j*) (j=1, 2, . . . , and n) is provided for each stage of the level shifter 222(*j*) and the buffer 223(*j*) such that it is electrically connected between the power supply lines 241*c* and 241*b*. In addition, the power input line 283(*j*) (j=1, 2, . . . , and n) supplies the power supply VLL to each stage of the level shifter 222(*j*) and the buffer 223(*j*).

The electrostatic protecting diode 303(*j*) is provided in the middle of the power input line 283(*j*) provided for each stage of the level shifter 222(*j*) and the buffer 223(*j*) and protects each stage of the level shifter 222(*j*) and the buffer 223(*j*) from the static electricity generated at or accumulated in the power supply lines 241*c* and 241*b*.

The power input line 284(*j*) is provided for each stage of the level shifter 222(*j*) and the buffer 223(*j*) such that it is electrically connected between the power supply lines 241*b* and 241*c*. In addition, the power input line 284(*j*) (j=1, 2, . . . , and n) supplies the power supply VSS to each stage of the level shifter 222(*j*) and the buffer 223(*j*).

The electrostatic protecting diode 304(*j*) is provided in the middle of the power input line 284(*j*) provided for each stage of the level shifter 222(*j*) and the buffer 223(*j*) and protects each stage of the level shifter 222(*j*) and the buffer 223(*j*) from the static electricity generated at or accumulated in the power supply lines 241*c* and 241*b*.

The power input line 285(*j*) is provided for each stage of the shift register 221(*j*) such that it is electrically connected between the power supply lines 241*a* and 241*b*. In addition, the power input line 285(*j*) (j=1, 2, . . . , and n) supplies the power supply VDD to each stage of the shift register 221(*j*).

The electrostatic protecting diode 305(*j*) is provided in the middle of the power input line 285(*j*) provided for each stage of the shift register 221(*j*) and protects each stage of the shift register 221(*j*) from the static electricity generated at or accumulated in the power supply lines 241*a* and 241*b*.

The power input line 286(*j*) is provided for each stage of the shift register 221(*j*) such that it is electrically connected between the power supply lines 241*a* and 241*b*. In addition, the power input line 286(*j*) (j=1, 2, . . . , and n) supplies the power supply VSS to each stage of the shift register 221(*j*).

The electrostatic protecting diode 306(*j*) is provided in the middle of the power input line 286(*j*) provided for each stage of the shift register 221(*j*) and protects each stage of the shift register 221(*j*) from the static electricity generated at or accumulated in the power supply lines 241*a* and 241*b*.

The electrostatic protecting diodes 303(*j*), 304(*j*), 305(*j*) and 306(*j*) are provided near the shift register 221(*j*), the level shifter 222(*j*), and the buffer 223(*j*) as compared to the protecting circuit provided at the outside of the power input lines 283(*j*), 284(*j*), 285(*j*), and 286(*j*) for supplying the power supply to the shift register 221(*j*), the level shifter 222(*j*), and the buffer 223(*j*), that is, provided on the power supply line 241*a*, 241*b*, or 241*c*. Therefore, the electrostatic protecting diodes 303(*j*), 304(*j*), 305(*j*), and 306(*j*) can suitably protect the shift register 221(*j*), the level shifter 222(*j*), and the buffer 223(*j*) from the static electricity accumulated in the power supply line 241*a*, 241*b*, or 241*c*.

Electronic Apparatus

Next, various electronic apparatuses having the above-described organic EL display device mounted therein will be described. The various electronic apparatuses, which will be described in detail later, includes any one of the driving circuits of the electro-optical panels according to the first to fourth embodiments. In addition, the various electronic apparatuses, which will be described in detail, may include the driving circuit of the electro-optical panel according to the fifth embodiment.

A: Mobile Computer

Figure 12:
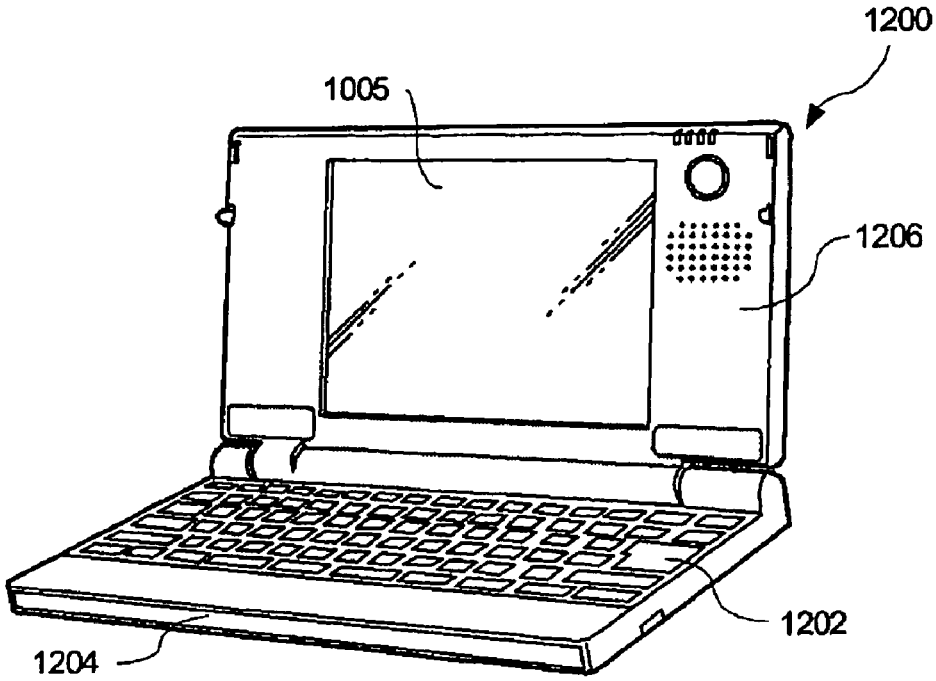
FIG. 12 is a perspective view of a computer according to an embodiment of the invention.

An example in which the above-described organic EL display device is applied to a mobile personal computer will be described with reference to FIG. 12. FIG. 12 is a perspective view showing the configuration of a computer 1200.

In FIG. 12, the computer 1200 includes a main body 1204 having a keyboard 1202 and a display device 1206 having a display unit 1005 composed of the organic EL display device (not shown). The display unit 1005 can display an image having a high quality and improve reliability of the overall device. By providing the organic EL elements which emit light components corresponding to three primary colors of red, green, and blue on a plurality of organic EL display substrates included in the display unit 1005, the display unit 1005 can display images with full color display.

B: Cellular Phone

Figure 13:
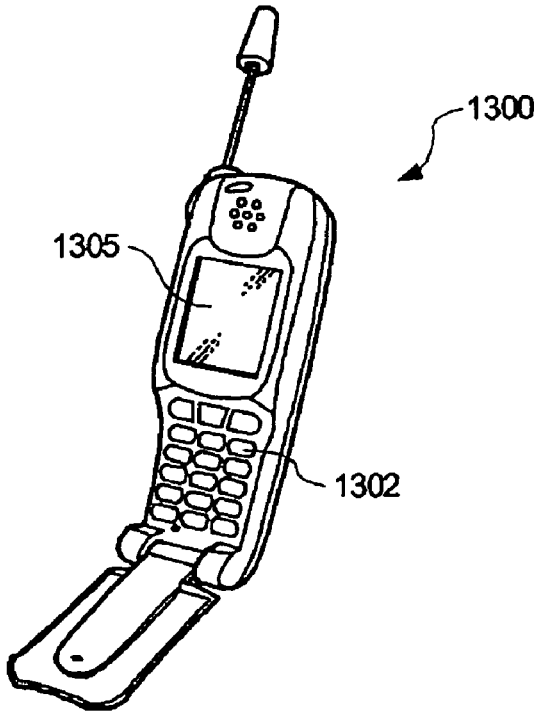
FIG. 13 is a perspective view of a cellular phone according to another embodiment of the invention.

Further, an example in which the above-described organic EL display device is applied to a cellular phone will be described with reference to FIG. 13. FIG. 13 is a perspective view showing the configuration of a cellular phone 1300. In FIG. 13, the cellular phone 1300 includes a plurality of operation buttons 1302 and a display unit 1305 having the organic EL display device according to the first embodiment.

Similar to the above-described display unit 1005, the display unit 1305 can display an image having a high quality and improve reliability. Since a yield of an organic EL display panel included in the display unit 1305 is improved, it is possible to reduce a cost of the overall cellular phone 1300 and to increase durability of the cellular phone 1300. In addition, a plurality of organic EL elements included in the display unit 1305 emit light components corresponding to three primary colors of red, green, and blue, so that the display unit 1305 can display images through full color display.

The invention is not limited to the above-described embodiments, but may be properly changed within a scope without departing from the sprit of the invention read from claims and the overall specification. A driving circuit for an electro-optical panel, a method of driving an electro-optical panel, and an electronic apparatus, which are changed or modified, are within a technical scope of the invention.

What is claimed is:

1. A driving circuit for an electro-optical panel in which a plurality of pixel portions are provided in an image display region, the driving circuit comprising:

a plurality of power supply lines that are respectively supplied with power supplies having different potentials from a power supply circuit;

a shift register that outputs transfer signals defining timings at which image signals are supplied to the plurality of pixel portions;

a level shifter that is connected to at least one power supply line and another power supply line supplied with different potentials among the plurality of power supply lines and that increases the voltage levels of the output transfer signals by using the power supplies having the different potentials supplied through the one power supply line and the other power supply line; and an electrostatic protecting circuit having a diode that is provided between the one power supply line and the other power supply line and that forms an electrical path to release static electricity applied to one of the one power supply line and the other power supply line to the other.

2. The driving circuit for an electro-optical panel according to claim 1, wherein the driving circuit includes a data line driving circuit that supplies the image signals to the pixel portions through signal lines provided in the electrooptical panel according to the transfer signals having increased voltages and that drives the electro-optical panel.

3. The driving circuit for an electro-optical panel according to claim 2, wherein the electro-optical panel is a current-driven electro-optical panel; and the data line driving circuit samples or latches the image signals according to the transfer signals having the increased voltages and supplies the sampled or latched image signals to the signal lines.

4. The driving circuit for an electro-optical panel according to claim 1, wherein the driving circuit includes a scanning line driving circuit that uses the transfer signals having increased voltages as scanning signals, supplies the scanning signals to the pixel portions through a plurality of scanning lines provided in the electro-optical panel, and drives the electro-optical panel.

5. The driving circuit for an electro-optical panel according to claim 1, wherein the electro-optical panel is an organic electroluminescent (EL) panel.

6. The driving circuit for an electro-optical panel according to claim 1, wherein a plurality of diodes are connected in parallel between the one power supply line and the other power supply line.

7. The driving circuit for an electro-optical panel according to claim 1, wherein the electrostatic protecting circuit is provided for each stage of the level shifter.

8. The driving circuit for an electro-optical panel according to claim 1, wherein the electrostatic protecting circuit is provided for every plural stages of the level shifter.

9. The driving circuit for an electro-optical panel according to claim 1, further comprising:

a buffer that is connected to an output side of the level shifter and that is connected to the one power supply line and another power supply line to buffer the transfer signals having increased voltages by using the power supplies having the different potentials.

10. The driving circuit for an electro-optical panel according to claim 1, wherein the one power supply line and the other power supply line include at least one of a highest power supply line to supply a power supply having a highest potential and a lowest power supply line to supply a power supply having a lowest potential among the plurality of power supply lines; and the electrical path includes at least one of a path passing through the highest power supply line and a path passing through the lowest power supply line.

11. A driving circuit comprising:

an electronic circuit that has a plurality of unit circuits;

a power supply line that commonly supplies power to the plurality of unit circuits;

a power input line that connects from the power supply line to each of the plurality of unit circuits; and a protecting circuit that is connected to the power input line, and configured to protect the unit circuit.

12. The driving circuit according to claim 11, wherein the driving circuit is a driving circuit for an electro-optical panel in which a plurality of pixel portions are provided in an image display region;

the power supply line has at least one power supply line and another power supply line which supply different potentials; and the unit circuit includes a shift register that outputs transfer signals defining timings at which image signals are supplied to the plurality of pixel portions and a level shifter that increases the voltage levels of the output transfer signals by using the power supplies having the different potentials.

13. The driving circuit according to claim 12, wherein the driving circuit includes a data line driving circuit that supplies the image signals to the pixel portions through signal lines provided in the electrooptical panel according to the transfer signals having increased voltages and that drives the electro-optical panel.

14. The driving circuit according to claim 13, wherein the electro-optical panel is a current-driven electro-optical panel; and the data line driving circuit samples or latches the image signals according to the transfer signals having the increased voltages and supplies the sampled or latched image signals to the signal lines.

15. The driving circuit according to claim 12, wherein the driving circuit includes a scanning line driving circuit that uses the transfer signals having increased voltages as scanning signals, supplies the scanning signals to the pixel portions through a plurality of scanning lines provided in the electro-optical panel, and drives the electro-optical panel.

16. The driving circuit according to claim 11, wherein the electro-optical panel is an organic EL panel.

17. The driving circuit according to claim 11, wherein the protecting circuit is a diode.

18. The driving circuit according to claim 11, wherein the protecting circuit is provided for each stage of the level shifter.

19. The driving circuit according to claim 11, wherein the protecting circuit is provided for every plural stages of the level shifter.

20. The driving circuit according to claim 11, further comprising:

a buffer that is connected to an output side of the level shifter and that is connected to the one power supply line and another power supply line to buffer the transfer signals having increased voltages by using the power supplies having the different potentials.

21. The driving circuit according to claim 11, wherein the one power supply line and another power supply line include at least one of a highest power supply line to supply a power supply having a highest potential and a lowest power supply line to supply a power supply having a lowest potential among the plurality of power supply lines; and the electrical path provided by the protecting circuit includes at least one of a path passing through the highest power supply line and a path passing through the lowest power supply line.

22. A method of driving an electro-optical panel in which a plurality of pixel portions are provided in an image display region, the method comprising:

supplying a plurality of power supplies having different potentials from a power supply circuit to a plurality of power supply lines, respectively;

outputting transfer signals defining timings at which image signals are supplied to the plurality of pixel portions by a shift register;

increasing the voltage levels of the output transfer signals by using the power supplies having the different potentials supplied through the one power supply line and another power supply line by a level shifter connected to at least the one power supply line and the other power supply line supplied with the different potentials among the plurality of power supply lines; and forming an electrical path to release static electricity applied to one of the one power supply line and the other power supply line to the other by a diode which is provided between the one power supply line and the other power supply line.

23. An electro-optical device comprising the driving circuit for an electro-optical panel according to claim 1 and the electro-optical panel.

24. An electronic apparatus comprising the electrooptical device according to claim 23.

25. An electro-optical device comprising:

a plurality of pixels;

data lines being connected to the plurality of the pixels; and a data line driving circuit supplying a data signal to the data lines, the data driving circuit comprising:

an electronic circuit having a plurality of unit circuits;

a power supply line that commonly supplies an electrical potential to the plurality of unit circuits;

a power input line that connects the power supply line and each of the plurality of unit circuits; and a protecting circuit that is connected to the power input line, and configured to protect the unit circuit.

26. An electronic apparatus comprising the electro-optical device according to claim 25.

* * * * *